US008596382B2

(12) United States Patent
Clark et al.

(10) Patent No.: US 8,596,382 B2
(45) Date of Patent: Dec. 3, 2013

(54) MAGNETIC RANGING WHILE DRILLING USING AN ELECTRIC DIPOLE SOURCE AND A MAGNETIC FIELD SENSOR

(75) Inventors: Brian Clark, Sugar Land, TX (US); Jaideva C. Goswami, Sugar Land, TX (US)

(73) Assignee: Schlumbeger Technology Corporation, Sugar Land, TX (US)

( * ) Notice: Subject to any disclaimer, the term of this patent is extended or adjusted under 35 U.S.C. 154(b) by 666 days.

(21) Appl. No.: 12/105,698

(22) Filed: Apr. 18, 2008

(65) Prior Publication Data

US 2009/0260879 A1 Oct. 22, 2009

(51) Int. Cl.
*E21B 47/02* (2006.01)

(52) U.S. Cl.
USPC ..... 175/45; 175/73; 166/66.5; 324/345

(58) Field of Classification Search
USPC ..... 175/45, 61, 62, 26, 73–76; 166/66.5
See application file for complete search history.

(56) References Cited

U.S. PATENT DOCUMENTS 3,406,766 A * 10/1968 Henderson ..... 175/61
4,323,848 A 4/1982 Kuckes
4,372,398 A * 2/1983 Kuckes ..... 175/45
4,443,762 A 4/1984 Kuckes
4,529,939 A 7/1985 Kuckes
4,593,770 A 6/1986 Hoehn
4,700,142 A 10/1987 Kuckes
4,791,373 A 12/1988 Kuckes
4,845,434 A 7/1989 Kuckes
4,933,640 A 6/1990 Kuckes
4,957,172 A 9/1990 Patton
5,074,365 A 12/1991 Kuckes
5,131,477 A 7/1992 Stagg
5,218,301 A 6/1993 Kuckes
5,258,755 A 11/1993 Kuckes
5,305,212 A 4/1994 Kuckes
5,323,856 A 6/1994 Davis
5,343,152 A 8/1994 Kuckes
5,485,089 A 1/1996 Kuckes
5,512,830 A 4/1996 Kuckes
5,513,710 A 5/1996 Kuckes
5,515,931 A 5/1996 Kuckes
5,589,775 A 12/1996 Kuckes
5,657,826 A 8/1997 Kuckes
5,676,212 A 10/1997 Kuckes (Continued)

OTHER PUBLICATIONS

U.S. Appl. No. 60/882,598, filed Aug. 16, 2005, Clark, et al.

(Continued)

*Primary Examiner* — Daniel P Stephenson
*Assistant Examiner* — Elizabeth Gitlin
(74) *Attorney, Agent, or Firm* — Kimberly Ballew

(57) ABSTRACT

A system and methods for drilling a well in a field having an existing well are provided. Specifically a method of drilling a new well in a field having an existing well includes drilling the new well using a bottom hole assembly (BHA) having a drill collar divided by an insulated gap, generating a current on the drill collar of the BHA while drilling the new well, and measuring from the existing well a magnetic field caused by the current on the drill collar of the BHA. Using measurements of the magnetic field, a relative position of the new well to the existing well may be determined.

19 Claims, 21 Drawing Sheets

(56) References Cited

U.S. PATENT DOCUMENTS

| | | | | |
|---|---|---|---|---|
| 5,725,059 | A | 3/1998 | Kuckes et al. | |
| 5,923,170 | A | 7/1999 | Kuckes | |
| 5,960,370 | A | 9/1999 | Towle et al. | |
| 2002/0130663 | A1 | 9/2002 | Kuckes et al. | |
| 2003/0085059 | A1 | 5/2003 | Kuckes et al. | |
| 2003/0188891 | A1 | 10/2003 | Kuckes | |
| 2004/0040745 | A1 | 3/2004 | Kuckes | |
| 2004/0069514 | A1* | 4/2004 | Rodney et al. | 174/35 R |
| 2005/0082057 | A1* | 4/2005 | Newton et al. | 166/256 |
| 2005/0211469 | A1 | 9/2005 | Kuckes et al. | |
| 2006/0065441 | A1 | 3/2006 | Kuckes | |
| 2006/0066454 | A1 | 3/2006 | Kuckes et al. | |
| 2006/0131013 | A1* | 6/2006 | McElhinney | 166/250.01 |
| 2006/0283598 | A1* | 12/2006 | Kasevich | 166/302 |
| 2007/0126426 | A1 | 6/2007 | Clark et al. | |

OTHER PUBLICATIONS

U.S. Appl. No. 11/781,704, filed Jul. 23, 2007, Clark.

U.S. Appl. No. 11/833,032, filed Aug. 2, 2007, Clark, et al.

J.E. Walstrom, et al.; "An analysis of Uncertainty in Directional Surveying"; *Journal of Petroleum Technology*, Apr. 1969; pp. 515-523.

H. S. Williamson, "Accuracy Prediction for Directional Measurement While Drilling"; *SPE Drilling and Completion*, vol. 15, No. 4; Dec. 2000; pp. 221-233.

C.J.M. Wolff, et al.; "Borehole Position Uncertainty—Analysis of Measuring Methods and Derivation of Systematic Error Model"; *Journal of Petroleum Technology*, Dec. 1981; pp. 2330-2350.

W H Press et al., Numerical Recipes in C The Art of Scientific Computing, 2d ed., Ch. 15.6 Confidence Limits on Estimated Model Parameters, Cambridge Univ. Press, pp. 689-699 (1992).

* cited by examiner

MAGNETIC RANGING WHILE DRILLING USING AN ELECTRIC DIPOLE SOURCE AND A MAGNETIC FIELD SENSOR

BACKGROUND OF THE INVENTION

The present invention relates generally to well drilling operations and, more particularly, to well drilling operations using magnetic field measurements from an electric dipole to ascertain the relative location of a new well to an existing well.

Heavy oil may be too viscous in its natural state to be produced from a conventional well. To produce heavy oil, a variety of techniques may be employed, including, for example, Steam Assisted Gravity Drainage (SAGD), Cross Well Steam Assisted Gravity Drainage (X-SAGD), or Toe to Heel Air Injection (THAI). While SAGD wells generally involve two parallel horizontal wells, X-SAGD and THAI wells generally involve two or more wells located perpendicular to one another.

X-SAGD and THAI techniques function by employing one or more wells for steam injection or air injection, respectively, known as "injector wells." The injector wells pump steam or air into precise locations in a heavy oil formation to heat heavy oil. One or more lower horizontal wells, known as "producer wells," collect the heated heavy oil. For an X-SAGD well pair including an injector well and a producer well, the injector well is a horizontal well located above and oriented perpendicular to the producer well. In contrast, for a THAI well pair including an injector well and a producer well, the injector well is a vertical well located near and oriented perpendicular to the producer well.

Steam or air from an injector well in an X-SAGD or THAI well pair should be injected at a precise point in the heavy oil formation to maximize recovery. Particularly, if steam is injected too near to a point of closest approach between the injector well and the producer well, steam may be shunted out of the formation and into the producer well. Using many conventional techniques, the point of closest approach between the two wells may be difficult to locate or the location of the point of closest approach may be imprecise.

Moreover, the relative distance between the injector and producer wells of an X-SAGD or THAI well pair may affect potential recovery. The wells should be located sufficiently near to one another such that heavy oil heated at the injector well may drain into the producer well. However, if the wells are located too near to one another, steam or air from the injector well may shunt into the producer well, and if the wells are located too far from one another, the heated heavy oil may not extend to the producer well. Using conventional techniques, it may be difficult to accurately drill one well perpendicular to another well.

SUMMARY

Certain aspects commensurate in scope with the originally claimed invention are set forth below. It should be understood that these aspects are presented merely to provide the reader with a brief summary of certain forms of the invention might take and that these aspects are not intended to limit the scope of the invention. Indeed, the invention may encompass a variety of aspects that may not be set forth below.

In accordance with an embodiment of the invention, a method of drilling a new well in a field having an existing well includes drilling the new well using a bottom hole assembly (BHA) having a drill collar divided by an insulated gap, generating a current on the drill collar of the BHA, and measuring from the existing well a magnetic field caused by the current on the drill collar of the BHA. Using measurements of the magnetic field, the relative position of the new well to the existing well may be determined.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

Figure 1:
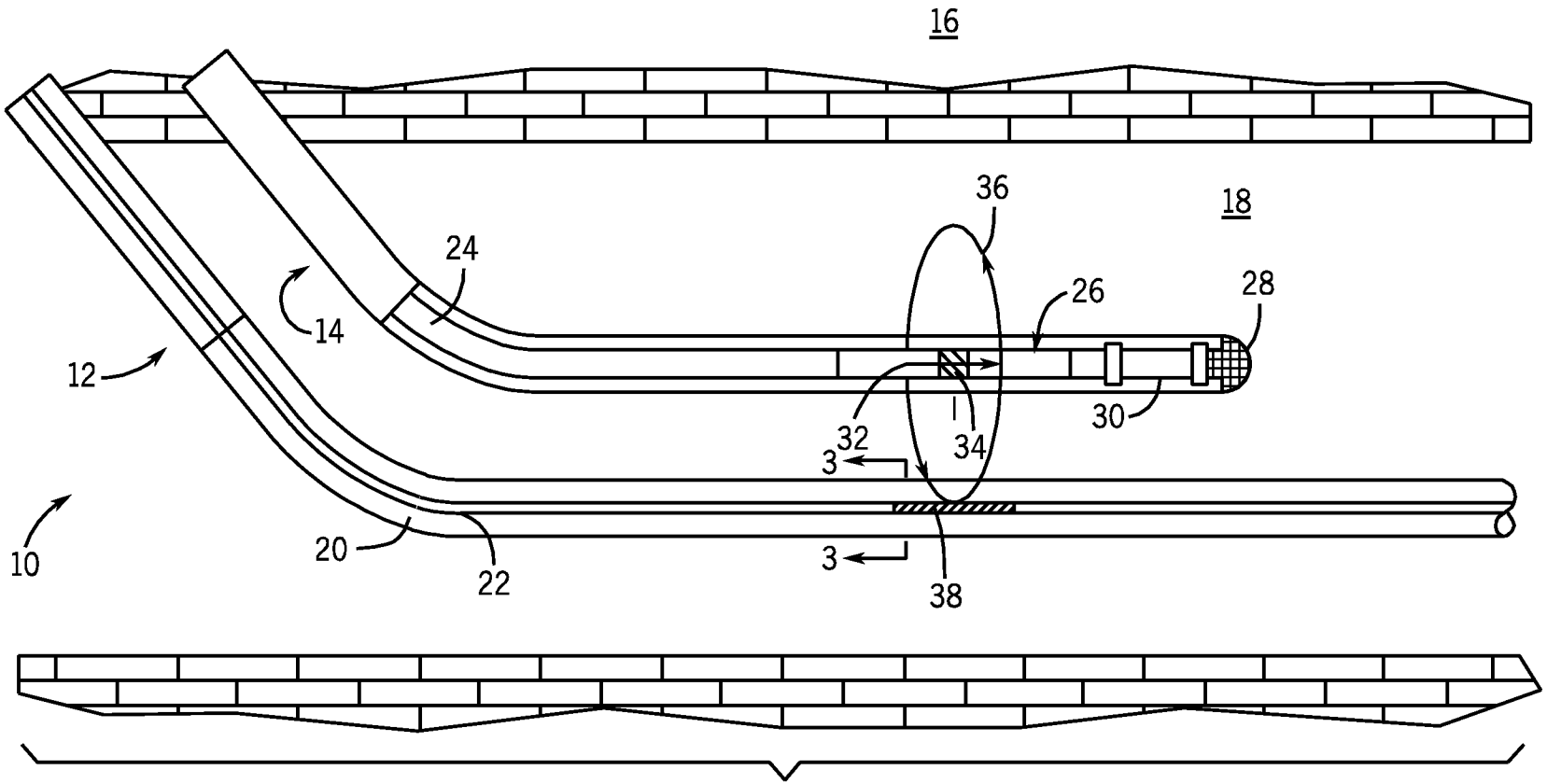
FIG. 1 is a schematic of a well drilling operation using magnetic ranging while drilling for a parallel well.

One or more specific embodiments of the present invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As used herein, the term "first well" (labeled numeral 12) refers to a generally horizontal existing well, "vertical well" (labeled numeral 52) refers to a generally vertical existing vertical well, and "second well" (labeled numeral 14) refers to a secondary well drilled in the vicinity of either the first well 12 or the vertical well 52. It should be appreciated, however, that the wells may be drilled in any order and that the terms are used to clarify the figures discussed below.

FIG. 1 depicts a well drilling operation 10 involving magnetic ranging while drilling. In the well drilling operation 10, an existing first well 12 and a new second well 14 extend from the surface through a formation 16 into a heavy oil zone 18. The first well 12 is cased with casing 20 and completed with tubing 22. A drill string 24 is used to drill the second well 14. The drill string 24 includes a bottom hole assembly (BHA) 26 having a drill bit 28 and a steerable system 30. The BHA 26 may also include a variety of drilling tools such as a measurement while drilling (MWD) tool or a logging while drilling (LWD) tool.

A tool in the BHA 26 generates an electric current 32 on both sides of an insulated gap 34 in the outer drill collar. The current 32 generates an azimuthal magnetic field 36 around the BHA 26. FIG. 1 depicts the magnetic field 36 centered on the insulated gap 34, but it should be understood that the magnetic field 36 extends along the length of the BHA 26 and beyond. A wireline magnetometer 38 may be deployed into the first well 12 using a tractor or a coiled tubing system, with which the strength of the magnetic field 36 may be measured at a variety of locations along the first well 12. With measured magnetic field 36 strength data obtained by the wireline magnetometer 38, the relative position between first well 12 and second well 14 may be ascertained.

Figure 2:
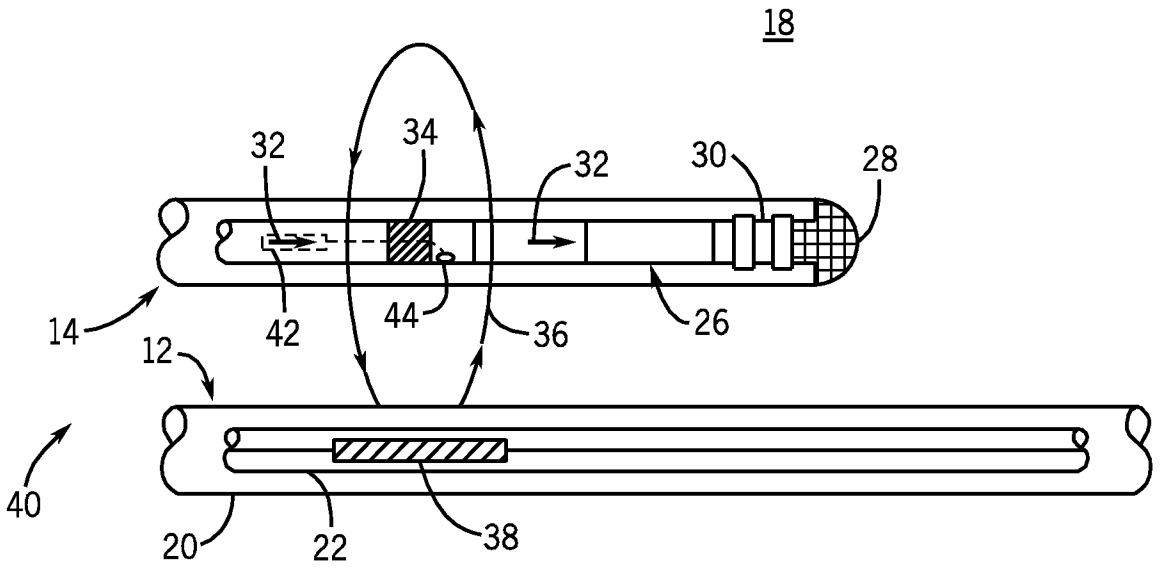
FIG. 2 is a schematic of a more detailed view of the well drilling operation of FIG. 1.

FIG. 2 provides a more detailed view 40 of the well drilling operation 10 of FIG. 1. As illustrated in the more detailed view 40, the BHA 26 includes an electric current driving tool 42, which may be a component of a measurement while drilling (MWD) tool such as Schlumberger's E-Pulse or E-Pulse Express tool or a standalone tool. The electric current driving tool 42 generates the electric current 32 on an outer drill collar 44 located on the opposite side of the insulated gap 34. The more detailed view 40 also illustrates that when the first well 12 and the second well 14 are parallel, the magnetic field 36 generated by the electric current 32 may not necessarily be detected by the wireline magnetometer 38. Particularly, if the casing 20 is composed of a magnetic material such as alloy steel, the magnetic field 36 may be significantly attenuated and may not effectively penetrate the casing 20.

Figure 3:
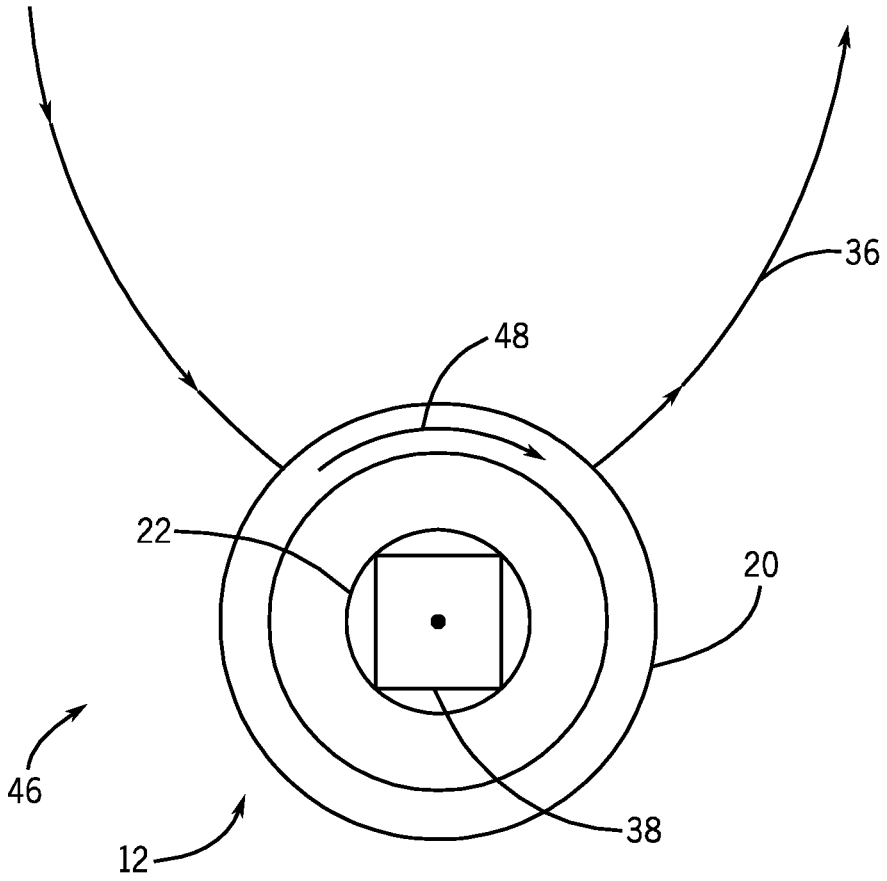
FIG. 3 is a cross-sectional view of an existing well taken along cut lines 3-3 in the well drilling operation of FIG. 1.

Turning to FIG. 3, a cross-sectional view 46 of the first well 12, depicted from along the cut lines 3-3 of FIG. 1, illustrates the attenuation of the magnetic field 36 which may occur when the first well 12 and the second well 14 are parallel and the casing 20 is composed of a magnetic material. In the cross-sectional view 46, the wireline magnetometer 38 is deployed within the tubing 22 and surrounded by the casing 20, which may be assumed to be alloy steel. When the first well 12 and the second well 14 are parallel, the azimuthal magnetic field 36 from the second well 14 will be perpendicular to the first well 12. To the extent the magnetic field 36 is perpendicular to the casing 20, the magnetic field 36 may be significantly attenuated. As such, a re-directed magnetic field path 48 may effectively route the magnetic field 36 around the casing 20 of the first well 12, largely preventing its detection by the wireline magnetometer 38.

Figure 4:
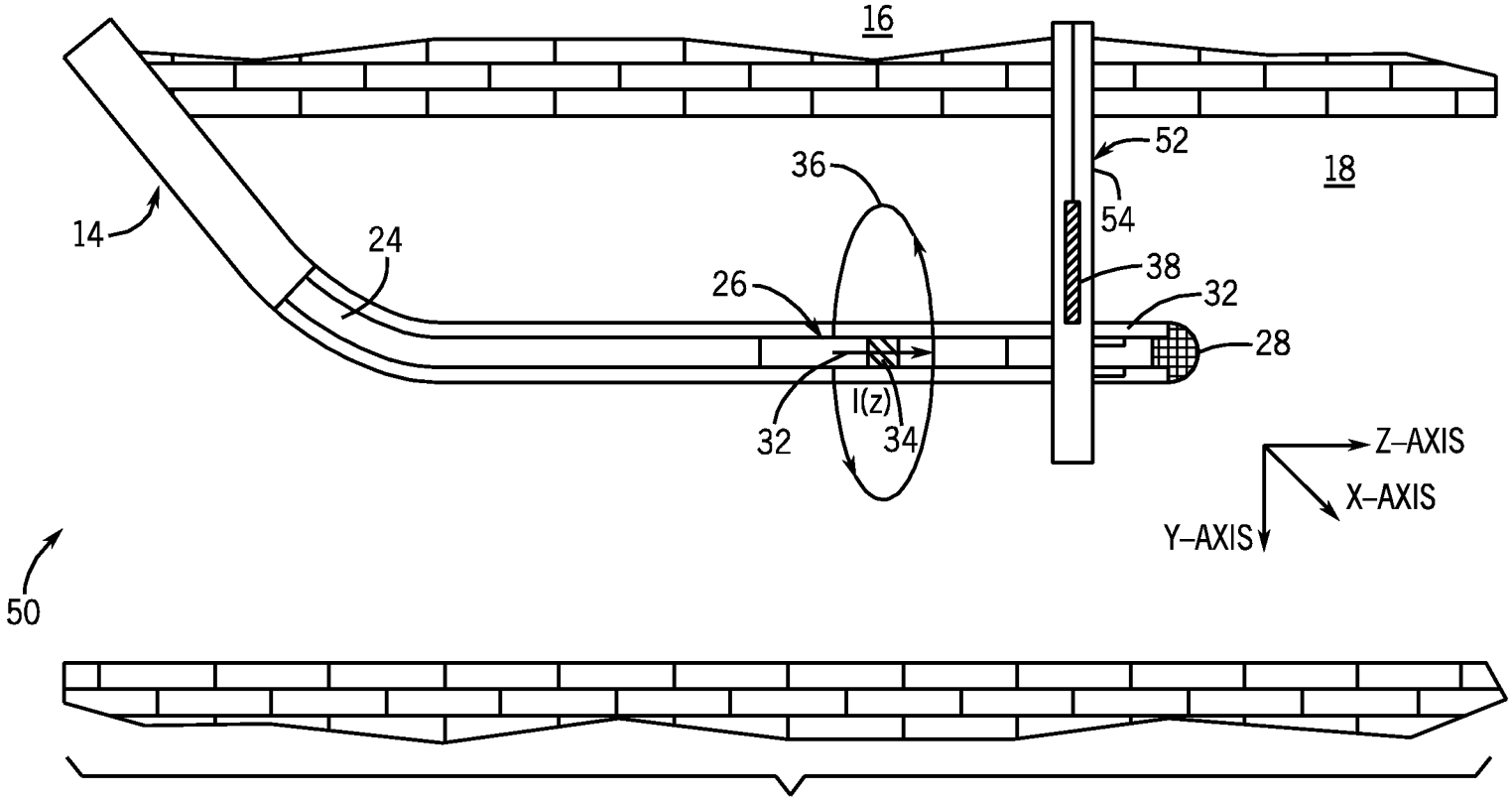
FIG. 4 is a schematic depicting a well drilling operation for drilling a Toe to Heel Air Injection (THAI) well using magnetic ranging while drilling in accordance with an embodiment of the invention.

FIG. 4 illustrates a well drilling operation 50 for drilling a horizontal well perpendicular to a vertical well. It should be noted that because the wells depicted in FIG. 4 are not parallel, but perpendicular, the magnetic field 36 may be largely undiminished by the presence of magnetic casing. It should be further noted that many applications may benefit from an accurate placement of perpendicular wells, and though the well drilling operation 50 depicted relates primarily to Toe to Heel Air Injection (THAI), the methods described herein may be well suited to developing a variety of such applications.

As will be understood, THAI is an in situ combustion process involving horizontal wells for producing oil and combustion by-products and vertical wells for injecting air into the heavy oil zone 18. The injected air causes some heavy oil in the heavy oil zone 18 to combust, which heats the surrounding heavy oil, reducing its viscosity. In addition, some upgrading of the heavy oil to lighter oil may occur. Gravity causes the heated heavy oil and upgraded oil to collect in the horizontal wells below. One approach to THAI is depicted in the well drilling operation 50 of FIG. 4. First, a vertical well 52, known as an injector well, is drilled and cased with casing 54. The horizontal second well 14, known as a producer well, is subsequently drilled. Periodically, during the drilling of the second well 14, the magnetic field 36 may be measured from a wireline magnetometer 38 within the vertical well 52. Using measurements of the magnetic field 36 at various locations from within the vertical well 52, the precise location of the second well 14 relative to the vertical well 52 may be obtained. The trajectory of the BHA 26 may be properly adjusted such that the second well 14 is drilled at the proper distance and orientation from the vertical well 52. The well drilling operation 50 and, specifically, the spatial relationships of the second well 14 and the vertical well 52 will be described further below with respect to FIGS. 9-11.

Figure 5:
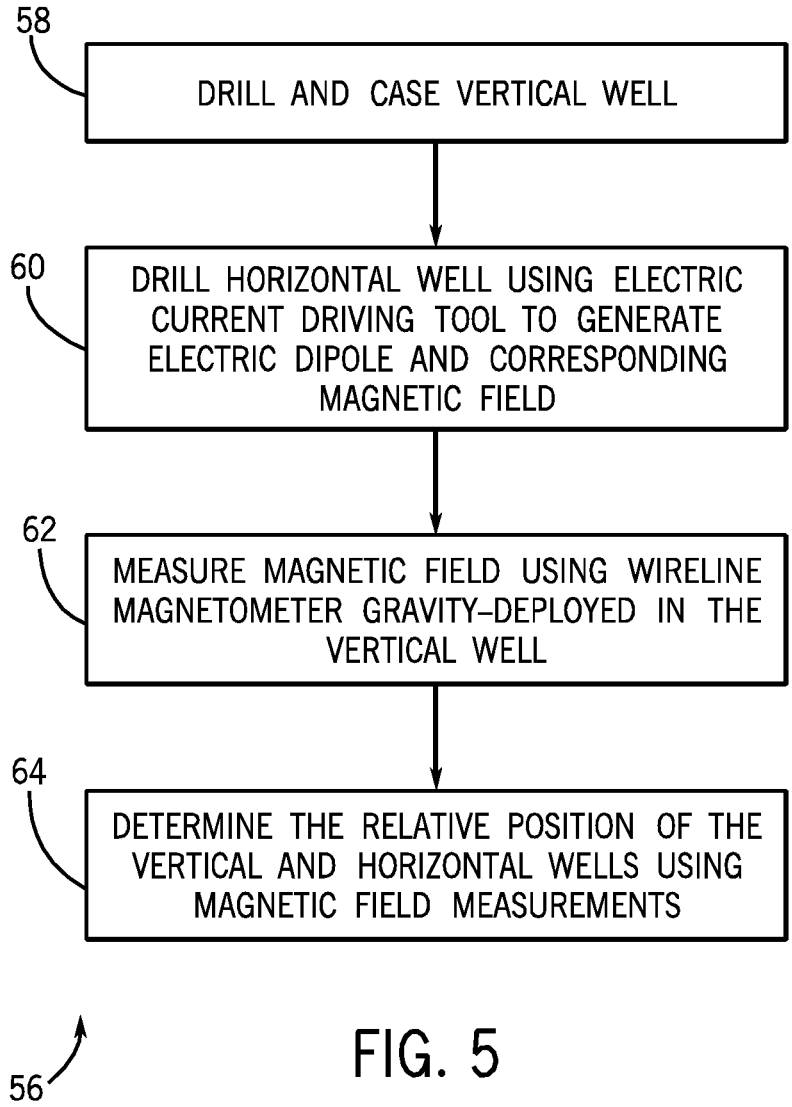
FIG. 5 is a flowchart describing an embodiment of a method of performing the well drilling operation of FIG. 4.

Turning to FIG. 5, a flow chart 56 describes one method for drilling the THAI well depicted in the well drilling operation 50 of FIG. 4. In first step 58, the vertical well 52 is drilled and cased with casing 54. Step 60 involves drilling the second well 14. Periodically, magnetic field measurements may be obtained while the second well 14 is being drilled. When the electric current driving tool 42 generates the electric current 32 on the drill collar of the BHA 26, an electric dipole is effectively formed from the two sides of the BHA 26 surrounding the insulated gap 34, producing the azimuthal magnetic field 36. In step 62, the gravity deployed wireline magnetometer 38 may measure the strength of the magnetic field 36 at a variety of points in the vertical well 52. In step 64, based on the measurements of the magnetic field, the relative position of the vertical well 52 and the second well 14 may be determined according to a technique discussed below.

Figure 6:
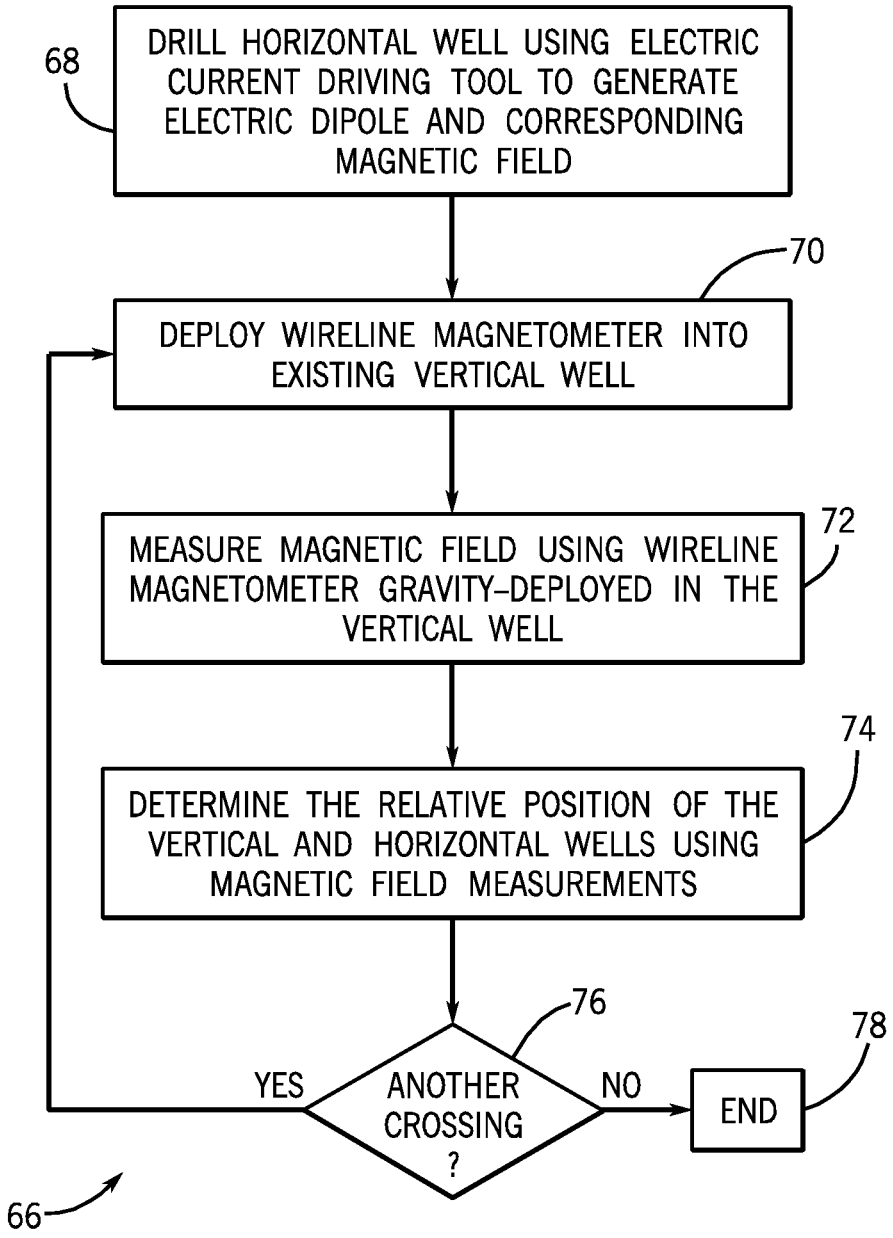
FIG. 6 is a flowchart depicting another embodiment of a method of performing the well drilling operation of FIG. 4.

FIG. 6 depicts an alternative flow chart 66 describing a method of drilling horizontal wells in fields having existing vertical wells. Particularly, for heavy oil fields that were originally developed using "huff and puff" or using a steam flood through vertical wells, a series of horizontal wells drilled among existing vertical wells may increase recovery. In such a situation, the existing vertical wells may be employed as steam injector wells, and the new horizontal wells may be employed as producer wells. In a first step 68, a horizontal well such as the second well 14 begins being drilled in a field with a plurality of existing vertical wells such as the vertical well 52. Periodically, magnetic field measurements may be obtained while the second well 14 is being drilled. When the electric current driving tool 42 generates the electric current 32 on the drill collar of the BHA 26, an electric dipole is effectively formed from the two sides of the BHA 26 surrounding the insulated gap 34, producing the azimuthal magnetic field 36.

In step 70, the wireline magnetometer 38 is gravity deployed into a first of the existing vertical wells such as vertical well 52. In step 72, the wireline magnetometer may measure the magnetic field 36 at a variety of points in the vertical well 52. Based on the measurements of the magnetic field 36, the relative position of the vertical well 52 and the second well 14 may be determined according to a technique discussed below. In decision block 76, if the horizontal second well 14 will cross another vertical well 52 in the field of existing vertical wells, the process returns to step 70 for drilling beyond the subsequent vertical well 52. If not, the process ends at step 78.

Figure 7:
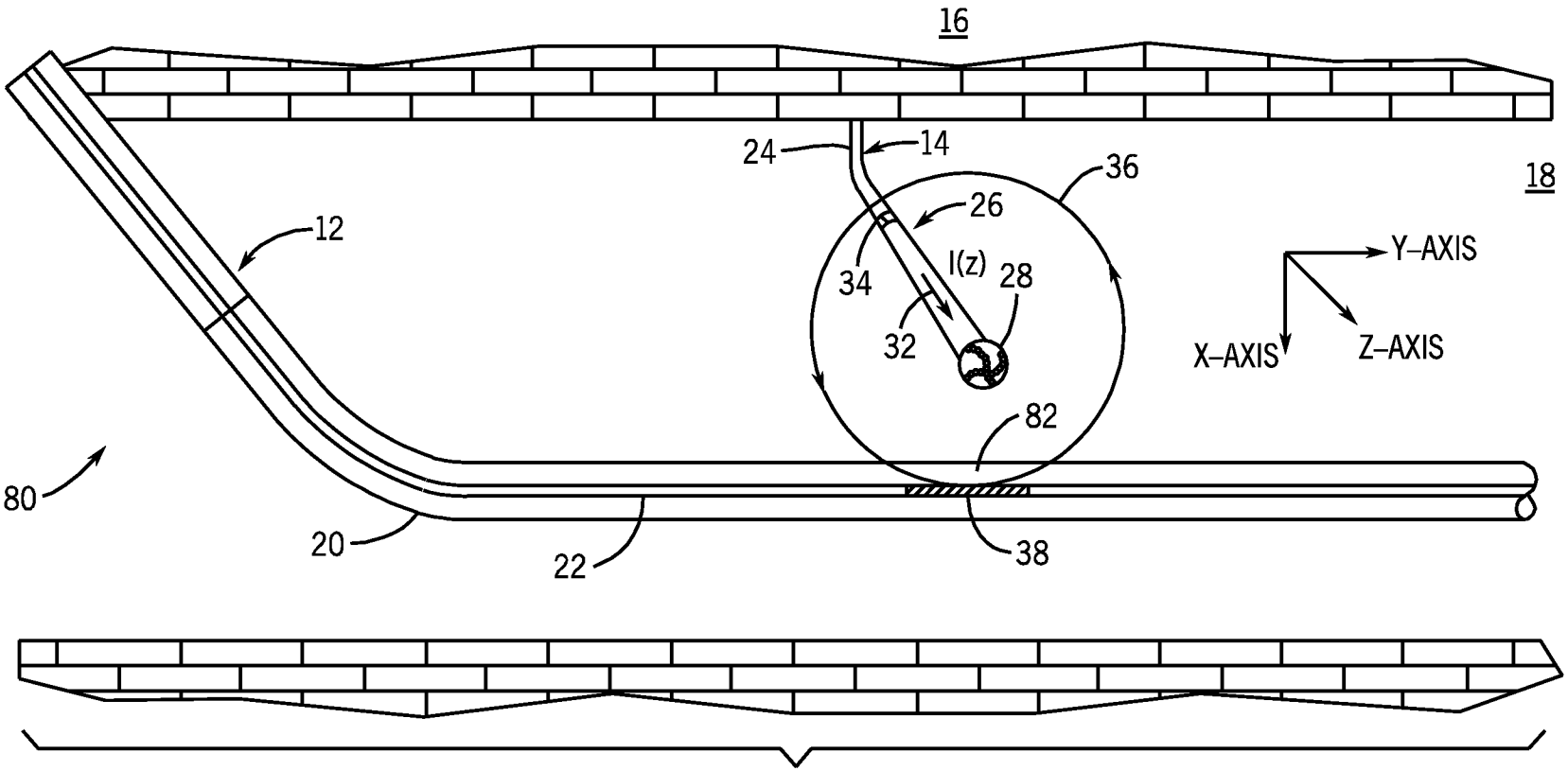
FIG. 7 is a schematic depicting a well drilling operation for drilling a Cross Well Steam Assisted Gravity Drainage (X-SAGD) well in accordance with an embodiment of the invention.

Turning to FIG. 7, a well drilling operation 80 depicts drilling two perpendicular wells for use in Cross Well Steam Assisted Gravity Drainage (X-SAGD) wells. A first horizontal well 12 is drilled through the formation 16 and into the heavy oil zone 18 before completion with casing 20 and tubing 22. A second well 14 is subsequently drilled above and perpendicular to the first well 12. Periodically, magnetic field measurements may be obtained while the second well 14 is being drilled. The electric current 32 on the drill collar of the BHA 26 may form an electric dipole from the two sides of the BHA 26 surrounding the insulated gap 34, producing the azimuthal magnetic field 36. As noted by numeral 82, because the second horizontal well 14 is perpendicular to the first horizontal well 12, the magnetic field 36 may be detected by the magnetometer 38 with little attenuation.

Figure 8:
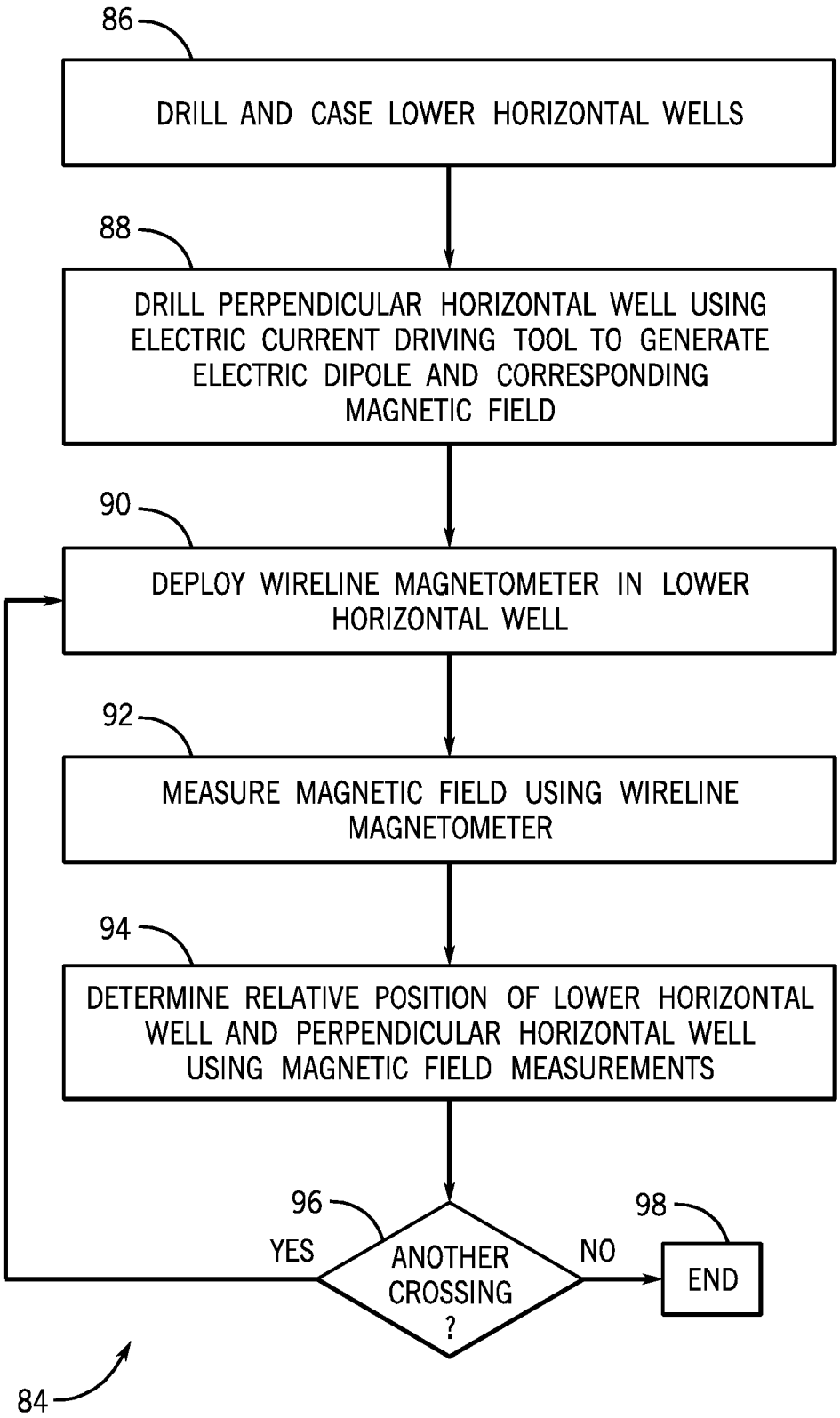
FIG. 8 is a flowchart describing an embodiment of a method of performing the well drilling operation of FIG. 7.

Turning to FIG. 8, a flowchart 84 depicts a method of drilling the X-SAGD well depicted in FIG. 7. In step 86, the first horizontal well 12 is drilled and completed with casing 20 and tubing 22. Step 88 involves drilling the perpendicular horizontal second well 14. Periodically, magnetic field measurements may be obtained while the second well 14 is being drilled. The electric current 32 on the drill collar of the BHA 26 may form an electric dipole from the two sides of the BHA 26 surrounding the insulated gap 34, producing the azimuthal magnetic field 36.

Continuing to view the flowchart 84 of FIG. 8, in step 90, the wireline magnetometer 38 is deployed in the first well 12 using a mud pump to push it down inside the tubing 22, or in case there is no tubing present, using a tractor, coiled tubing, or other means. In step 92, the magnetic field 36 may be detected by the wireline magnetometer 38 at a variety of locations along the first well 12. The data obtained by the wireline magnetometer 38 may be subsequently used in step 94 to determine the relative position of the first well 12 to the second well 14 using techniques described further below. Turning to the decision block 96, if the second well 14 will cross another horizontal well 12, the process returns to step 90 for drilling beyond the subsequent horizontal well 12. If not, the process ends at step 98.

It should be noted that if the two wells are exactly perpendicular then no current will be generated on the casing of the first well 12. However, if the two wells are not perpendicular, then a current may be generated on the casing of the first well 12. As a result, alternative techniques involving magnetic ranging while drilling from induced magnetic fields may be applied. Such techniques are described in Published Application US 2007/016426 A1, Provisional Application No. 60/822,598, application Ser. No. 11/833,032, and application Ser. No. 11/781,704, each of which is assigned to Schlumberger Technology Corporation and incorporated herein by reference.

Figure 9:
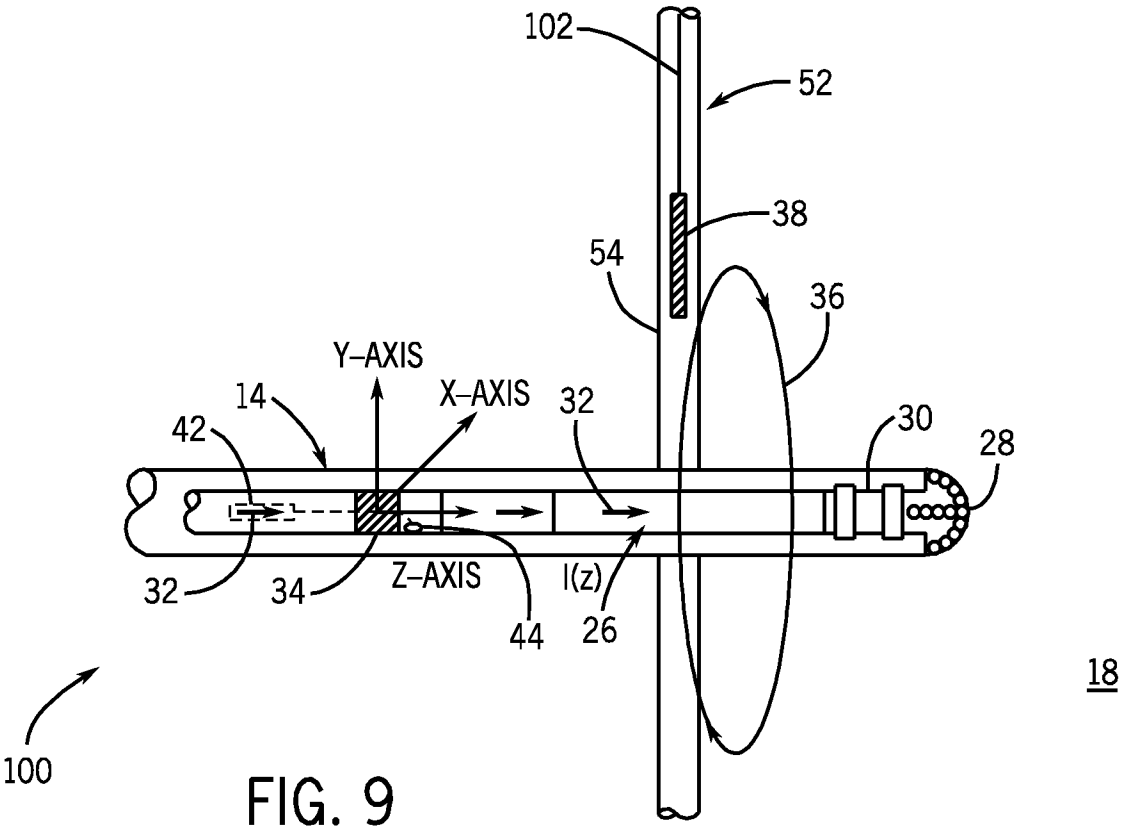
FIG. 9 is a schematic side view of the well drilling operation of FIG. 4.
Figure 10:
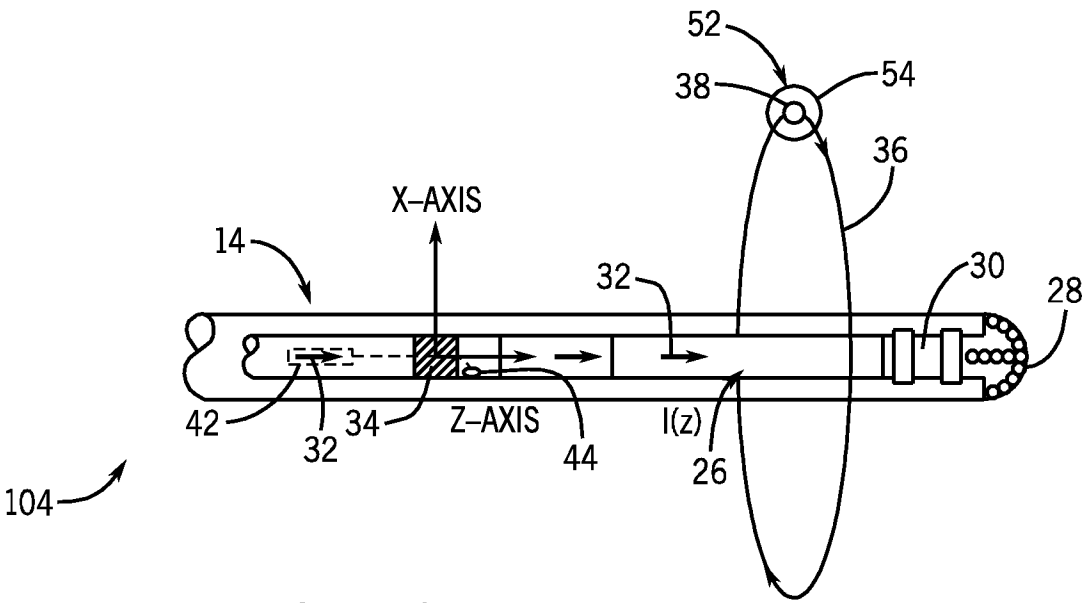
FIG. 10 is a schematic top view of the well drilling operation of FIG. 4.
Figure 11:
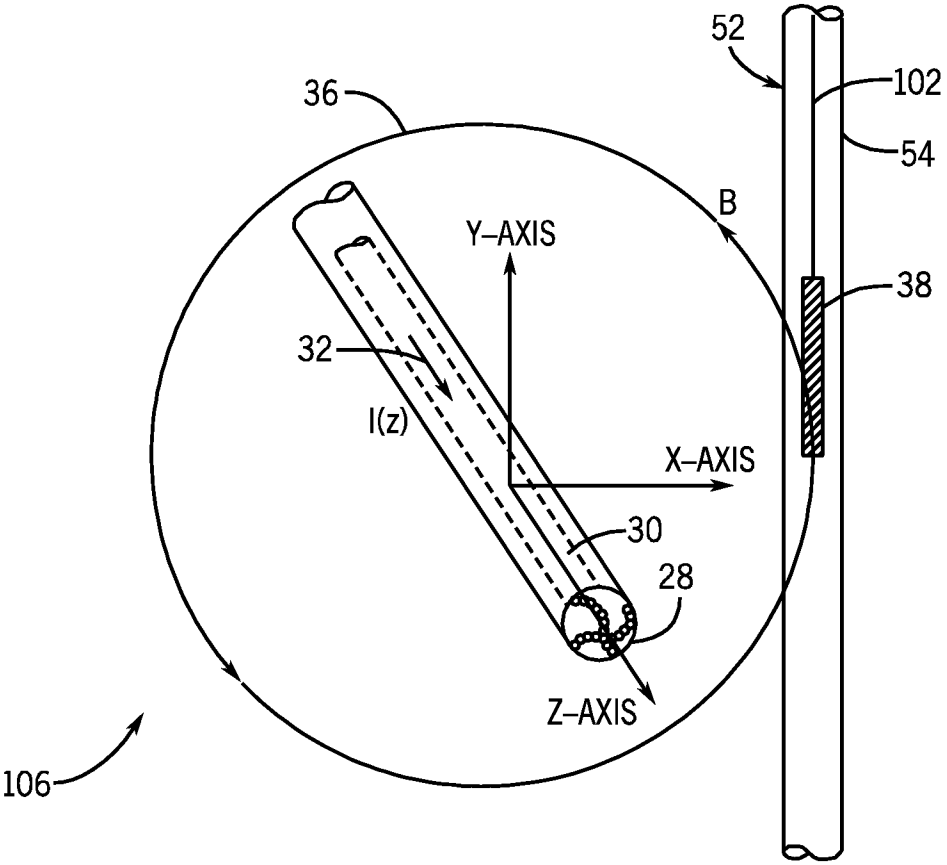
FIG. 11 is a schematic end view of the well drilling operation of FIG. 4.

FIGS. 9, 10, and 11 depict three different views of the well drilling operation 50 as depicted in FIG. 4 to illustrate the spatial relationship between the vertical well 52 and the second well 14. FIG. 9 depicts a side view 100 of the well drilling operation 50 of FIG. 4. As illustrated in the side view 100, the second well 14 is perpendicular to the vertical well 52. The second well is aligned with the z-axis. Meanwhile, the vertical well 52 is aligned with the y-axis. As a result, when the magnetometer 38 is raised and lowered on a wireline 102, the intensity of the magnetic field 36 may be defined as a function of distance along the y-axis.

FIG. 10 depicts a top view 104 of the well drilling operation 50 of FIG. 4. In the top view 104, the second well 14 is depicted as being offset from the vertical well 52 along the x-axis. As a result, the closest approach between the second well 14 and the vertical well 52 is correspondingly defined along the x-axis.

FIG. 11 depicts end view 106 of the well drilling operation 50 of FIG. 4. As indicated in the figure, the magnetometer 38 is raised and lowered along the y-direction by the wireline 102 within the vertical well 52. Thus, at various points across the y-axis, the intensity of the magnetic field 36 may be measured. As may be appreciated, for all three views 100, 104, and 106, the magnetometer 38 may detect the magnetic field 36 largely unimpeded by the casing 54, since the second well 14 is oriented perpendicularly to the vertical well 52.

Figure 12:
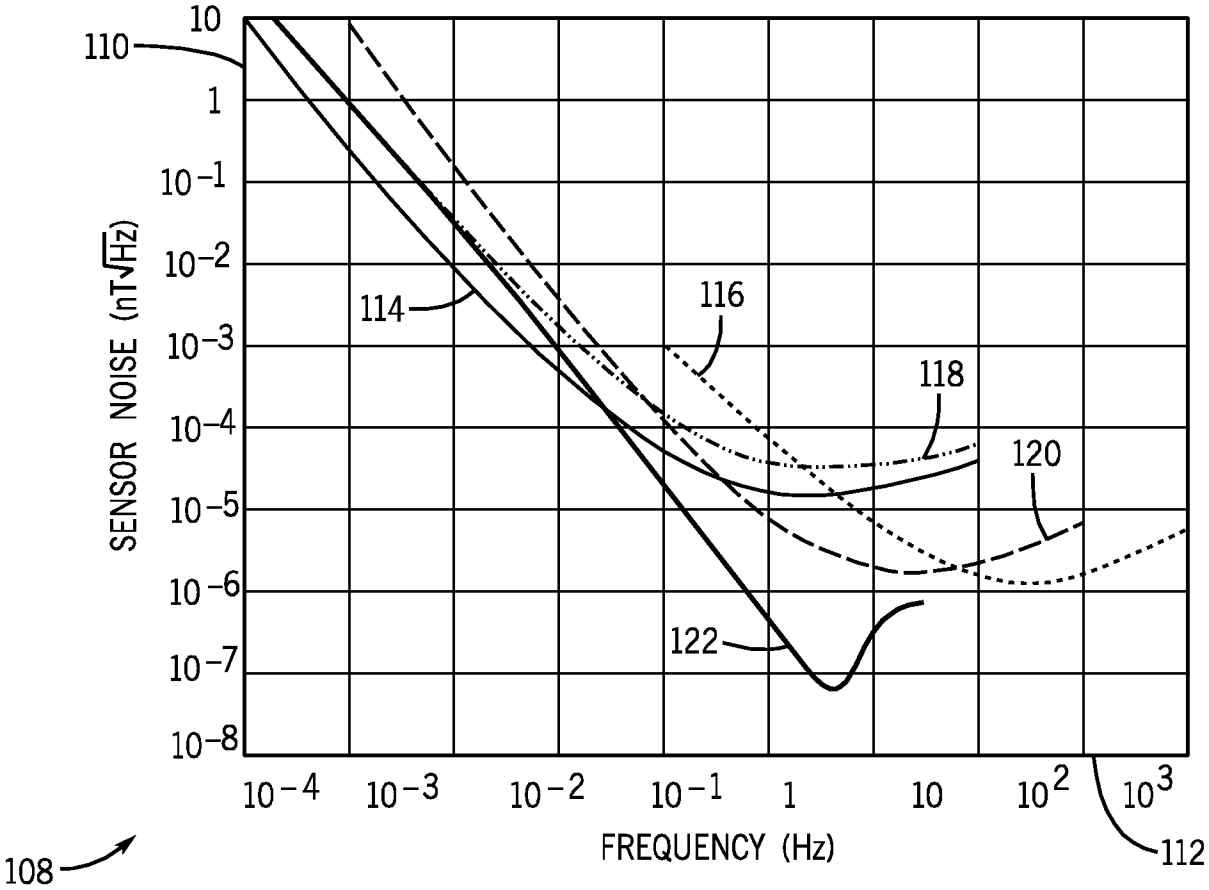
FIG. 12 is a plot of sensor noise of a plurality of available magnetometers for a variety of magnetic field frequencies.

Turning to FIG. 12, a plot 108 illustrates the sensitivity of available magnetometers for borehole use. An ordinate 110 represents sensor noise in units of nanoTesla per root Hertz ($nT/\sqrt{Hz}$), while an abscissa 112 represents frequency in units of Hertz (Hz). Lines 114, 116, 118, 120, and 122 respectively indicate the sensitivity of a BF-4 magnetometer, a BF-6 magnetometer, a BF-7 magnetometer, a BF-10 magnetometer, and a BF-17 magnetometer, all of which are manufactured by Schlumberger EMI Technology Center, in Richmond, Calif.

As apparent in the plot 108, noise figures may be exceptionally low for many of the BF series magnetometers. As will be discussed below, a magnetometer with one nanoTesla (nT) resolution should be sufficient to accurately estimate a distance of one well to another from at least fifty meters apart. The noise figures for the magnetometers described in the plot 108 achieve picoTesla (pT) noise levels per root Hertz ($pT/\sqrt{Hz}$). Thus, the available magnetometers should be sufficient to practice the technique disclosed herein.

Figure 13:
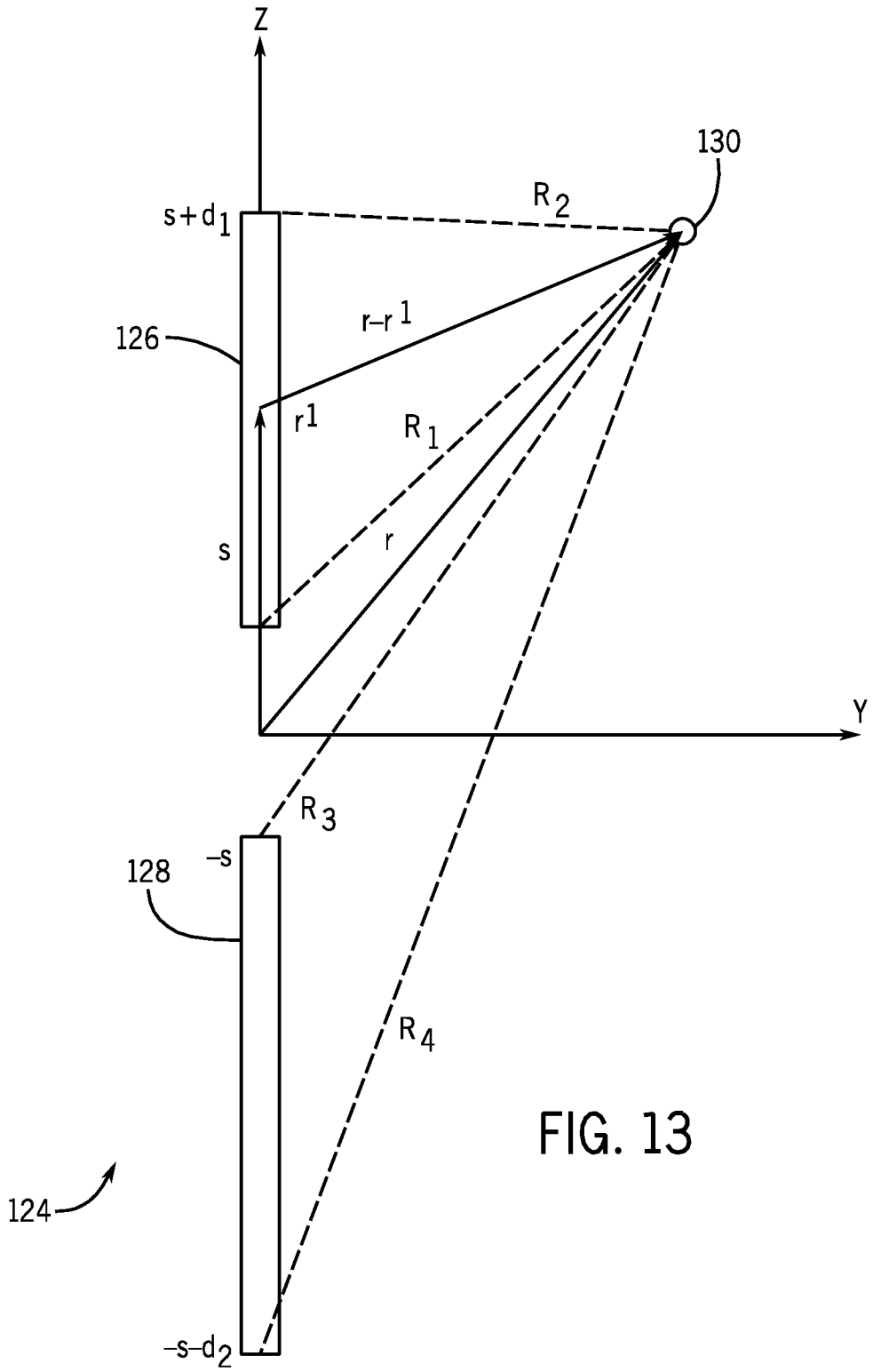
FIG. 13 is a diagram of an electric dipole formed as an electric current passes through a bottom hole assembly (BHA) divided by an insulated gap.

Turning to FIG. 13, an electric dipole 124 is depicted. The electric dipole 124 models the electric dipole which forms on the BHA 26 surrounding the insulated gap 34. The portion of the BHA 26 from the insulated gap to the drill bit 28 is noted in FIG. 13 as a first electric pole 126. The portion of the BHA 26 from the insulated gap through the drill string 24 is noted in FIG. 13 as a second electric pole 128. The second electric pole 128 on the BHA 26 is longer than the first electric pole 126 on the BHA 26, since the electric current 32 can extend onto the drill string 24 above the BHA 26. For a measurement point 130, which is located near the first pole 126, only a small error is introduced by truncating the length of the second electric pole 128. Additionally, since the magnetic field generated by an electric dipole in a conductive medium can be calculated analytically, the result may be used to model the magnetic field 36 generated by the electric dipole 124 formed by the BHA 26. The azimuthal magnetic field 36 strength created by the electric dipole 124 may be described by the following relationship:

$$H_\phi = \frac{I_0 y}{4\pi}\left[\int_{-W_2}^{-S} \frac{W_2 + z'}{d_2}\zeta_\phi esp(-jkR)\,dz' + \int_{-S}^{S}\zeta_\phi \exp(-jkR)\,dz' + \int_{S}^{W_1}\frac{W_1 - z'}{d_1}\zeta_\phi \exp(-jkR)\,dz'\right], \quad (1)$$

where $$W_1 = s + d_1,\ W_2 = s + d_2,\ \zeta_\phi = \frac{(1 + jkR)}{R^3},$$

$$R = |\vec{r} - \vec{r}'|,\ k^2 = \omega^2\mu_0\tilde{\varepsilon} = k_0^2\tilde{\varepsilon}_r,\ \text{and}\ \tilde{\varepsilon}_r = \varepsilon_r - j\frac{\sigma}{\omega\varepsilon_0}.$$

In the equations above, $d_1$ represents the length of the first electric pole 126, $d_2$ represents the length of the second electric pole 128, and s represents a distance from the center of the insulated gap 34 to the outer drill collar. Further, ω represents angular frequency, μ represents the permeability of free space, ϵ represents permittivity of the surrounding formation 18, σ represents electrical conductivity of the surrounding formation 18, and $I_0$ represents the magnitude of the electric current 32 at the insulated gap 34.

Equation (1) may be simplified as the frequency approaches zero, i.e., for frequencies of a few hundred Hertz or lower. Assuming the insulated gap 34 to be negligible in length compared to the length of the arms of the dipoles, in a limit when the frequency ω approaches zero, equation (1) may be rewritten as follows:

$$H_\phi = \frac{I_0 y}{4\pi}\left[\int_{-d_2}^{0}\frac{d_2 + z'}{d_2}\zeta_\phi \exp(-jkR)\,dz' + \int_{0}^{d_1}\frac{d_1 - z'}{d_1}\zeta_\phi \exp(-jkR)\,dz'\right]. \quad (2)$$

The integral in equation (2) above may be evaluated in closed form, providing the following equation:

$$H_\phi = \frac{I_0}{4y\pi}\left[\frac{\sqrt{y^2 + (d_1 - z)}}{d_1} - \left(\frac{1}{d_1} + \frac{1}{d_2}\right)\sqrt{y^2 + z^2} + \frac{\sqrt{y^2 + (d_2 + z)^2}}{d_2}\right]. \quad (3)$$

Based on the equations above modeling the magnetic field strength $H_\phi$, a vector magnetic field B at an arbitrary location (x, y, z) may be defined according to the following equation:

$$\overline{B}(x, y, z) = (-y\hat{x} + x\hat{y})\frac{\mu_0 I_0}{4\pi\rho^2}\left[\frac{\sqrt{\rho^2 + (d_1 - z)^2}}{d_1} - \left(\frac{1}{d_1} + \frac{1}{d_2}\right)\sqrt{\rho^2 + z^2} + \frac{\sqrt{\rho^2 + (d_2 - z)^2}}{d_2}\right] \quad (4)$$

where $$\rho = \sqrt{x^2 + y^2}.$$

It should be noted that this calculation does not include the attenuating effect that the casing 22 or 54 may have in the first well 12 or the vertical well 52. As a result, the field intensity may be reduced if the magnetometer 38 is concealed within magnetic casing. However, attenuation due to the casing 22 generally has a constant value, and this effect may be removed by calibration.

Equation (4) may be used to calculate the magnetic field and existing wellbore for any trajectory of a well being drilled at any angle and distance. For the data plotted in FIGS. 14-16, 19 and 20, the model parameters are as follows: $d_1$=30 m, $d_2$=80 m, s=0.2 m, and $I_0$=10 A.

Figure 14:
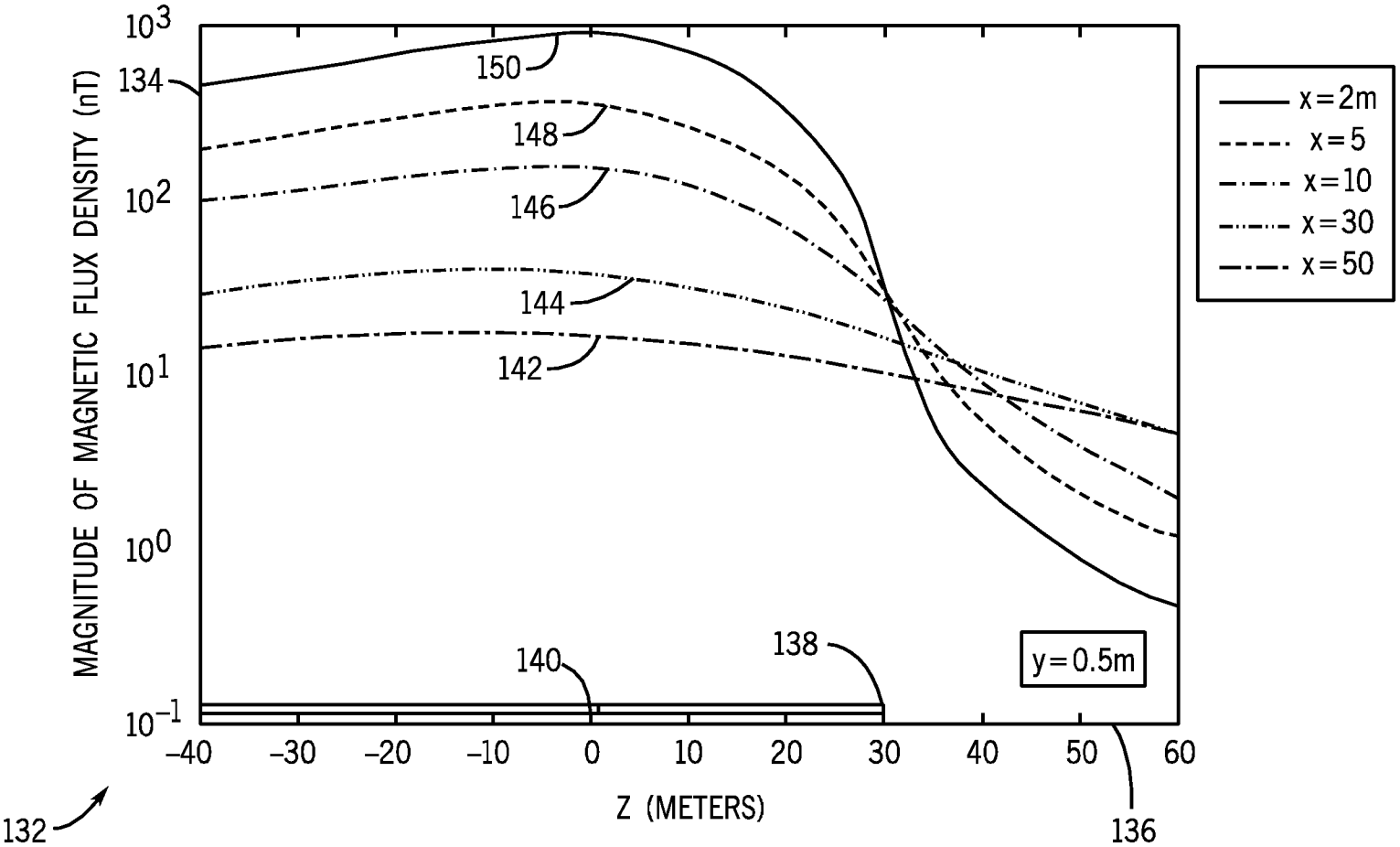
FIG. 14 is a plot of the magnitude of magnetic flux density as a function of distance along a BHA using magnetic ranging while drilling for a variety of offsets in the x-axis.

Turning to FIG. 14, plot 132 illustrates magnetic flux density as measured by the magnetometer 38 in the first well 12 for a variety of x-direction offsets of the second well 14. The following discussion applies equally to the vertical well 52 as to the first well 12. An ordinate 134 represents the absolute magnitude of magnetic flux density in units of nanoTesla (nT), and an abscissa 136 illustrates the distance in meters (m) along the z-direction from the insulated gap 34 on the BHA 26. Numeral 138 indicates the location of the drill bit 28 at z=30 m in the plot 132, and numeral 140 indicates the location on the plot in which the insulated gap 34 is disposed at z=0 m. The BHA 26 is located in the x-z plane, i.e., at y=0 m. The magnetic field 36 is measured at y=0.5 m above the x-z plane. Lines 142, 144, 146, 148, and 150 illustrate respectively the magnitude of magnetic flux density along the axial direction in the z-direction for offsets in the x-direction of 50 m, 30 m, 10 m, 5 m, and 2 m.

It should be noted that the magnetic flux density inside the first well 12 is greatest when the first well 12 is exactly opposite the insulated gap 34 in the BHA 26, which occurs when z=0 m. The coordinate system described in the plot 132 moves with the BHA 26. Hence, different values of z correspond to the position of the wireline magnetometer 38 in the first well 12 relative to the insulated gap 34 on the BHA 26 in the second well 14.

In the plot 132, the magnetic flux density in the first well 12 at z=0 m varies from 1000 nT at an offset distance of 2 m to 20 nT at an offset distance of 50 m. Thus, a magnetometer with 1 nT resolution should be able to accurately estimate the distance from the first well 12 to the BHA 26 drilling the second well 14 from at least 50 m away. As discussed above, available magnetometers are capable of such a resolution.

When the first well 12 is at z=0 meters, the drill bit 28 is 30 m beyond the point of closest approach to the first well 12. Thus, the distance between the two wells could be determined after passing the first well 12. This information may be particularly useful for evaluating the relative positions of two wells. The relative positions of the first well 12 and the second well 14 may be used for quality control or to plan production methods such as steam injection. For example, in X-SAGD, solid casing might be used near the crossing point to avoid a short path for the steam to travel between the two wells.

When the first well 12 is at z=30 m, the drill bit 28 is opposite the first well 12. The corresponding location on the abscissa 136, at point 138, indicates that the magnetic field intensity is ambiguous, as the curves overlap for the various x-direction offset distances between the two wells. Thus, the magnetic field measurements at z=0 m plotted in plot 132 of FIG. 14 alone may be insufficient to deduce the distance to the first well 12 from BHA 26 in the second well 14.

When the first well 12 is beyond z=30 m, the drill bit 28 of the BHA 26 in the second well 14 has not yet reached the point of closest approach of the first well 12. For example, at z=60 m on the plot 132, the lines of plot 132 are well resolved for different x-direction offset distances between the two wells. When the first well 12 is offset by 2 m from the second well 14, the magnetic flux density is very small, approaching 0.4 nT. When the first well 12 is offset by 30 m or more from the second well 14, the magnetic flux density is instead 4.5 nT. Thus, an approach which may be too close may be detected thirty meters ahead of the drill bit 28, and corrections may be made to the drilling trajectory by way of steerable system 30.

The change in the magnetic flux density as the BHA 26 continues to drill may also be used to estimate a transverse distance between the first well 12 and the second well 14. For example, observing the rate of change in magnetic flux density in drilling ten meters (for example, from z=30 m to z=20 m) may be used to estimate the relative separation of the first well 12 and second well 14. When the first well 12 is a substantial distance ahead of the drill bit 28, the magnetic flux is very weak. Thus, the magnetometer should have a resolution of at least 0.1 nT to perform such measurements of the drill bit 28. As indicated by plot 108 of FIG. 12, this resolution is within the capability of EMI EF magnetometers.

Figure 15:
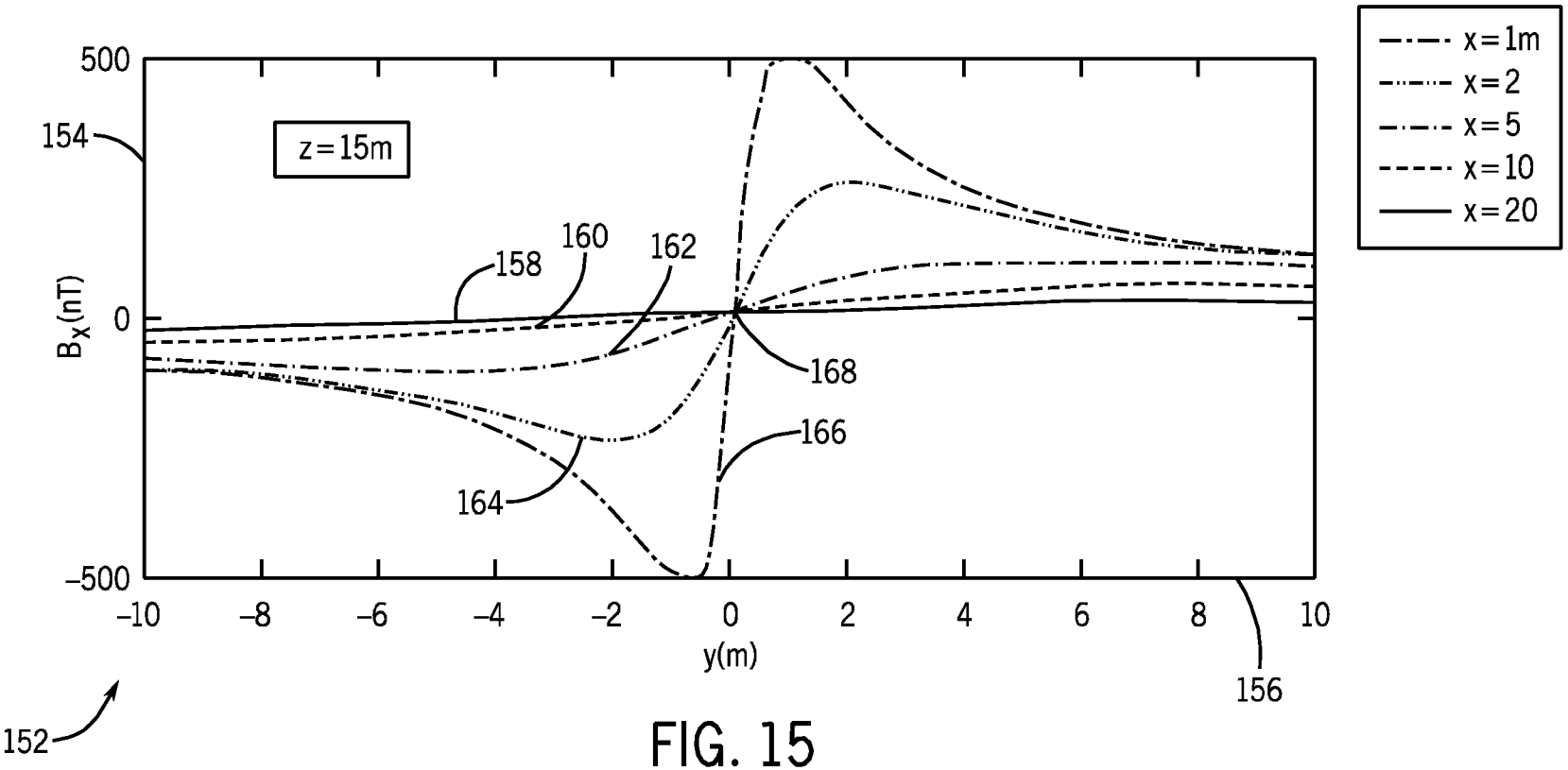
FIG. 15 is a plot of magnetic flux density in the x-axis as a function of distance in the y-axis from a BHA using magnetic ranging while drilling for a variety of offsets in the x-axis.
Figure 16:
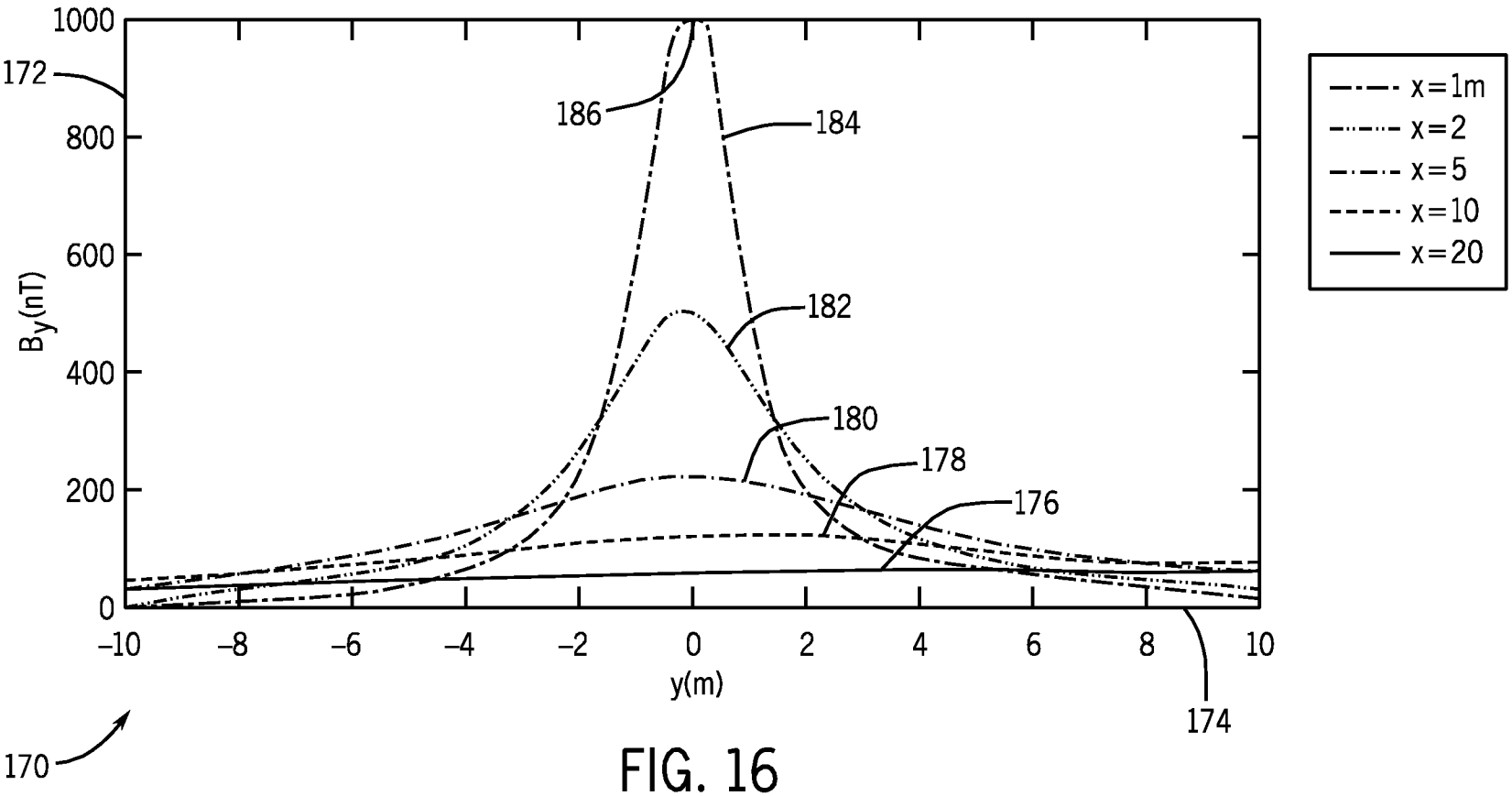
FIG. 16 is a plot of magnetic flux density in the y-axis as a function of distance in the y-axis from a BHA using magnetic ranging while drilling for a variety of offsets in the x-axis.

FIGS. 15 and 16 represent plots obtained from the well drilling operation 50 of FIGS. 4 and 9-11. Turning first to FIG. 15, a plot 152 illustrates magnetic flux density $B_x(y)$ in the x-direction as measured by the magnetometer 38 for a variety of x-direction offset locations for the first well 12. The first well 12 is located at z=15 m, midway between the drill bit 28 and the insulated gap 34 on the BHA 26. An ordinate 154 represents the magnetic flux density $B_x(y)$ in units of nanoTesla (nT), and an abscissa 156 represents the distance in meters (m) along the y-direction from the insulated gap 34 on the BHA 26. Lines 158, 160, 162, 164, and 166 illustrate respectively the magnitude of magnetic flux density $B_x(y)$ measured along the y-direction inside the first well 12 for offsets in the x-direction of 20 m, 10 m, 5 m, 2 m, and 1 m. When the wireline magnetometer 38 in the first well 12 crosses y=0 m, noted as numeral 168 on the plot 152, the magnetic flux density $B_x(y)$ changes sign. Since the point of closest approach in the y-direction between the first well 12 and the second well 14 occurs at y=0 m, the point of closest approach may be ascertained by observing the point at which $B_x(y)$ changes sign.

Turning next to FIG. 16, a plot 170 illustrates magnetic flux density $B_y(y)$ in the y-direction as measured by the magnetometer 38 for a variety of x-direction offset locations for the first well 12. As above, the first well 12 is located at z=15 m, midway between the drill bit 28 and the insulated gap 34 on the BHA 26. An ordinate 172 represents magnetic flux density $B_y(y)$, and an abscissa 174 represents the distance in meters (m) along the y-direction from the insulated gap 34 on the BHA 26. Lines 176, 178, 180, 182, and 184 illustrate respectively the magnitude of magnetic flux density $B_y(y)$ measured along the y-direction inside the first well 12 for offsets in the x-direction of 20 m, 10 m, 5 m, 2 m, and 1 m. When the wireline magnetometer 38 in the first well 12 crosses y=0 m, the magnetic flux density $B_y(y)$ reaches a local maximum 186. Since the point of closest approach in the y-direction between the first well 12 and the second well 14 occurs at y=0 m, the point of closest approach may be ascertained by observing the point at which $B_y(y)$ reaches a local maximum.

If the casing 22 of the first well 12 is made of a magnetic material such as steel, the magnetic flux density $B_x(y)$ will be attenuated and may not provide sufficient data to be useful. However, the magnetic flux density $B_y(y)$ is not attenuated by the casing 20. Thus, when the casing 22 of the first well 12 is magnetic, the peak amplitude located at local maximum 186 on plot 170 may be used to determine the distance between the two wells.

Figure 17:
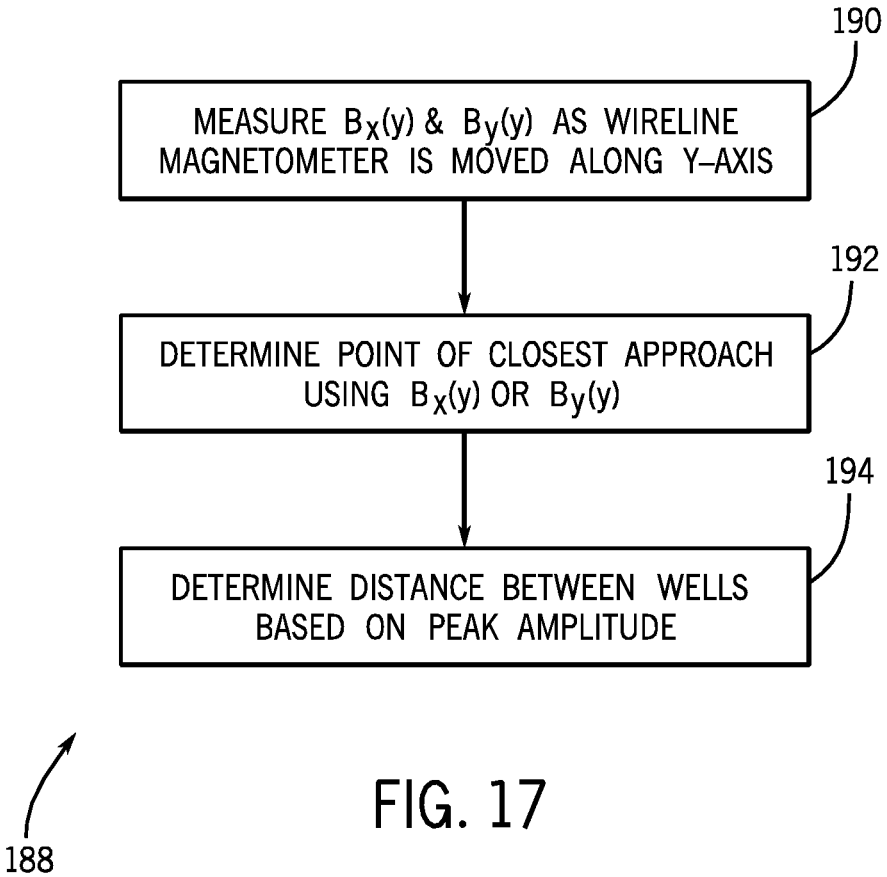
FIG. 17 is a flowchart describing a method of obtaining the relative positions between two perpendicular wells in accordance with an embodiment of the invention.

FIG. 17 represents a flowchart 188 for determining the location and distance of perpendicular wells as depicting in the well drilling operation 50 of FIGS. 4 and 9-11. In step 190, the gravity deployed magnetometer 38 is lowered into the vertical well 52 to measure the magnetic field density of the magnetic field 36, which arises from the electric current 32 on the BHA 26 in the second well 14. As the magnetometer moves through the vertical well 52 in the y-direction, the magnetic flux densities $B_x(y)$ and $B_y(y)$ may be observed.

In step 192, the observed magnetic flux densities $B_x(y)$ and $B_y(y)$ may be used to determine a point of closest approach between the second well 14 and the vertical well 52. If the casing 54 on the vertical well 52 is not magnetic, determining the point at which the magnetic flux density $B_x(y)$ changes sign may indicate the point of closest approach (i.e., when y=0 m). Regardless of whether the casing 54 on the vertical well 52 is magnetic, the magnetic flux density $B_y(y)$ may also indicate a point of closest approach. As discussed above, the point at which the magnetic flux density $B_y(y)$ reaches a local maximum indicates the point of closest approach (i.e., when y=0 m).

Step 194 of FIG. 17 illustrates that a distance between the vertical well 52 and the second well 14 at the point of closest approach may be obtained from the observed magnetic flux density $B_y(y)$. Through prior experimentation, distances associated with given values of magnetic flux density $B_y(y)$ may be obtained and developed into a table or algorithm. By comparing the observed value of magnetic flux density $B_y(y)$ at the point of closest approach with the experimental magnetic flux density $B_y(y)$, the distance between the vertical well 52 and the second well 14 at the point of closest approach may be ascertained.

Figure 18:
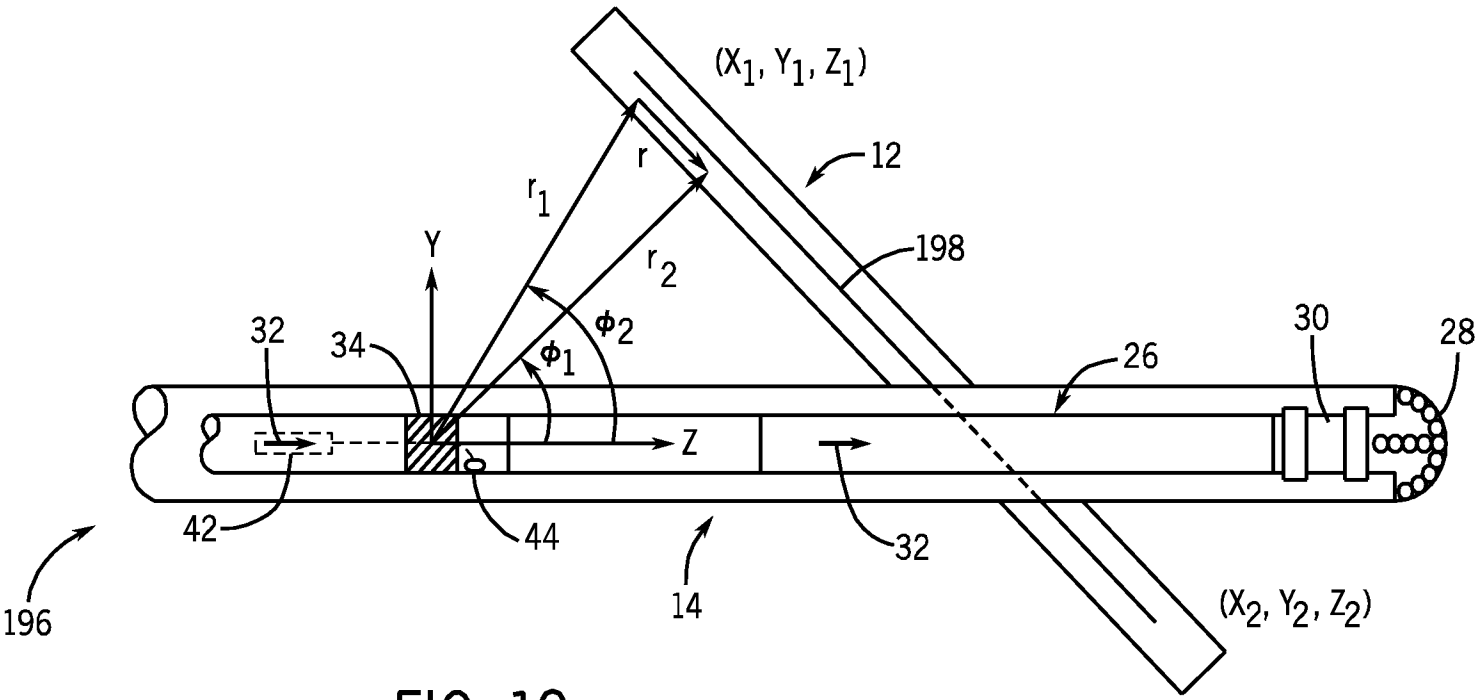
FIG. 18 is a schematic depicting a well drilling operation in which the relative positions between two wells may be ascertained when the two wells are not necessarily perpendicular.

FIG. 18 depicts a well drilling operation 196 for use when the second well 14 is not perpendicular to the first well 12. In the well drilling operation 196, the wireline magnetometer 38 measures the normal and axial components of magnetic field density ($B_n$ and $B_\tau$) along a magnetometer trajectory 198. From observed values of magnetic field density $B_n$ and $B_\tau$, distances $r_1$ and $r_2$ having respective angles $\phi_1$ and $\phi_2$ may be determined at points along the magnetometer trajectory 198, allowing an accurate establishment of the relative location between the first well 12 and the second well 14. Additionally, in a manner similar to that of the flowchart 188 of FIG. 17, the observed values of magnetic field density $B_n$ and $B_\tau$ may offer a precise location and distance between the first well 12 and the second well 14 at a point of closest approach, as discussed below.

Figure 19:
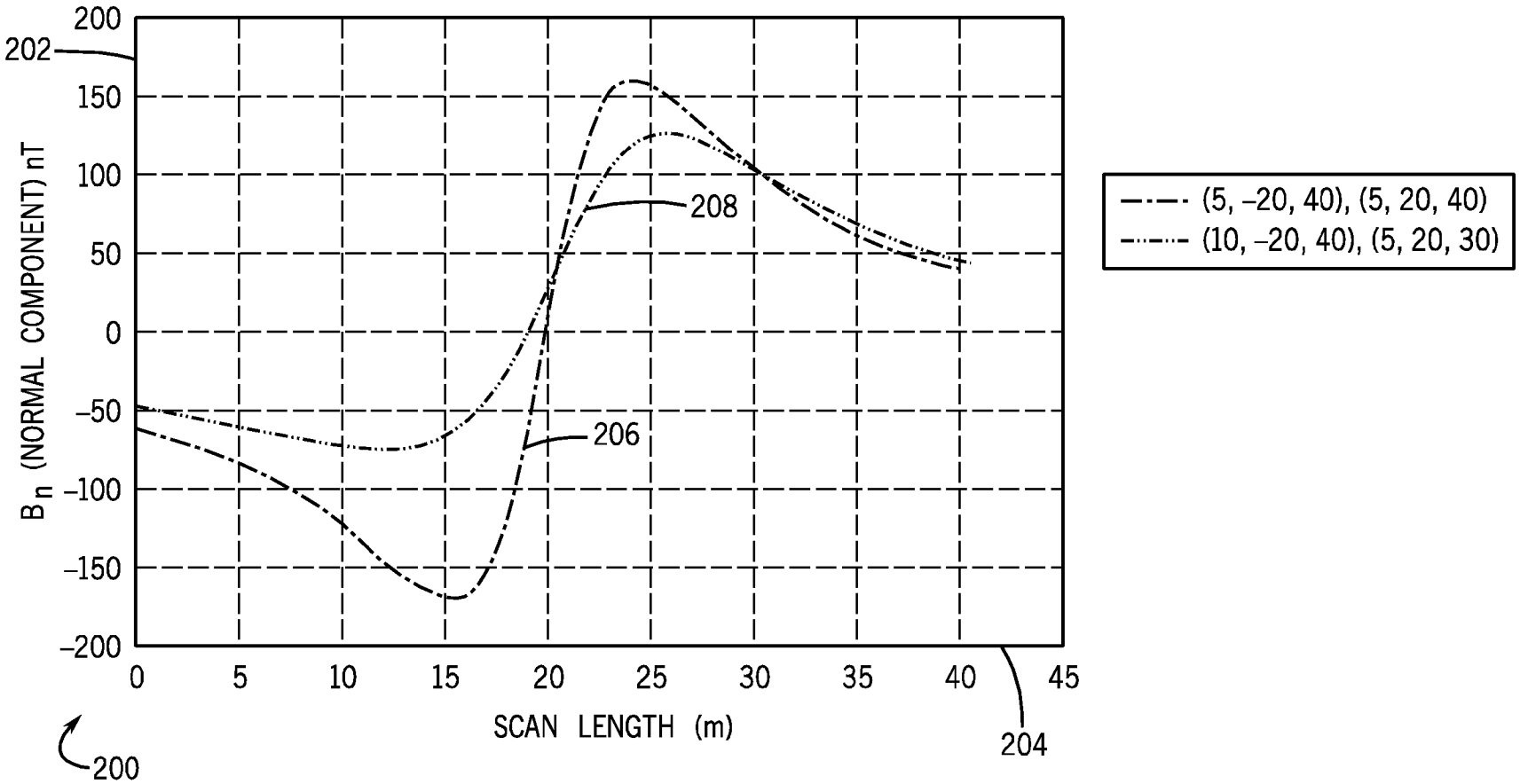
FIG. 19 is a plot of transverse magnetic flux density as a function of distance along the existing well depicted in FIG. 18.
Figure 20:
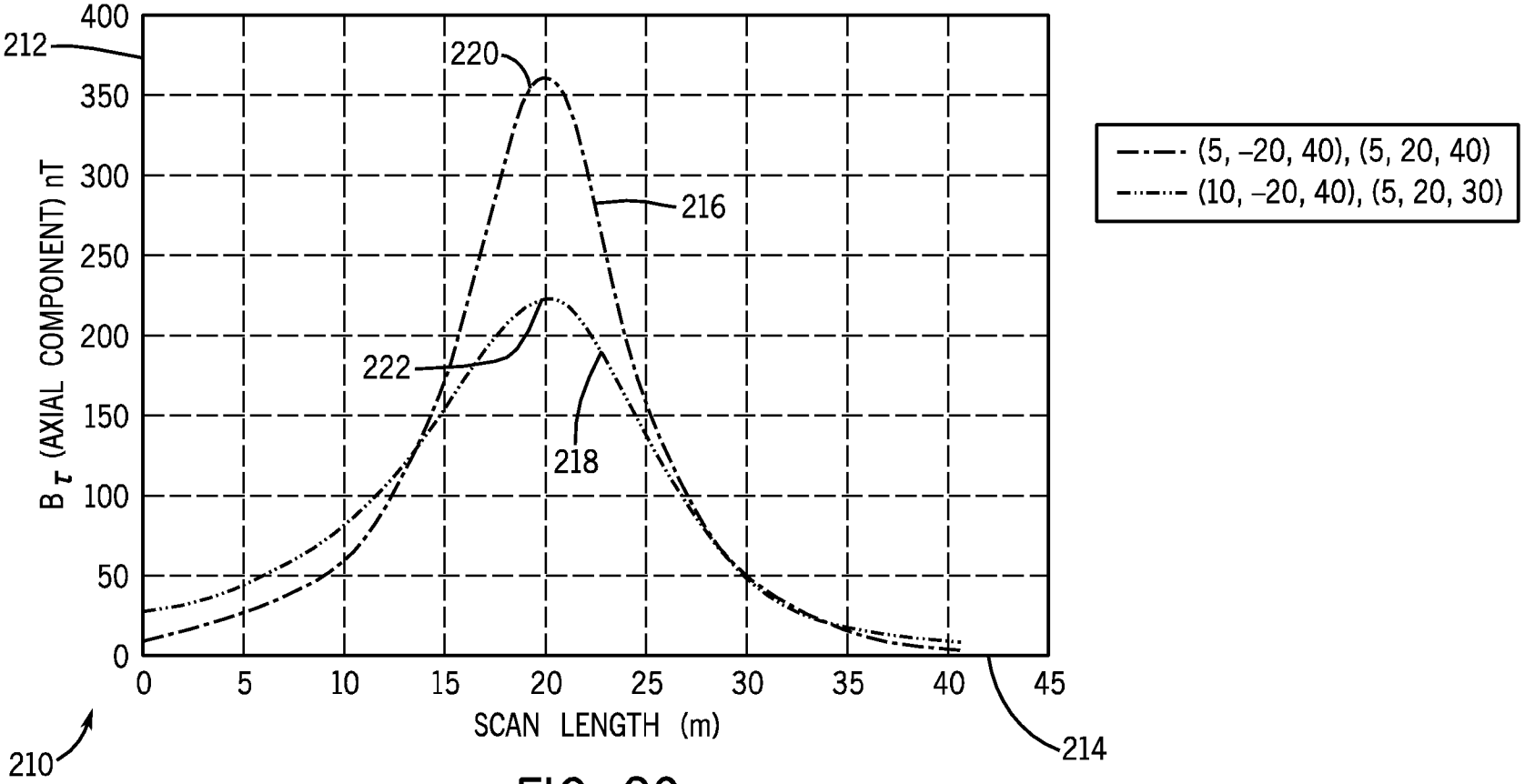
FIG. 20 is a plot of parallel magnetic flux density as a function of distance along the existing well depicted in FIG. 18.

FIGS. 19 and 20 illustrate plots of magnetic field density data obtained in the well drilling operation 196 of FIG. 18. Turning first to FIG. 19, a plot 200 illustrates a normal (i.e., perpendicular to the magnetometer trajectory 198) component of magnetic flux density $B_n$ as measured by the wireline magnetometer 38 for two possible variations of the trajectory of the second well 14 relative to the first well 12. An ordinate 202 represents the normal component of magnetic flux density $B_n$ in units of nanoTesla (nT) and an abscissa 204 represents the distance in meters (m) along the scan length of the magnetometer trajectory 198 in the first well 12. In the plot 200, line 206 indicates a magnetometer trajectory from coordinates of (x, y, z)=(5, −20, 40) to (x, y, z)=(5, 20, 40). Line 208 represents the magnetometer trajectory 198 from coordinates of (x, y, z) (10, −20, 40), to (x, y, z)=(5, 20, 30). Unlike the plot 152 of FIG. 15, the curves of the plot 200 are not symmetric about the point of closest approach. This result is expected because lines 206 and 208 illustrate a case when the magnetometer trajectory 198 of the first well 12 is not perpendicular to the axis of the second well 14.

Turning to FIG. 20, a plot 210 illustrates an axial (i.e., parallel to the magnetometer trajectory 198) component of magnetic flux density $B_\tau$ as measured by the wireline magnetometer 38 for the two variations of the trajectory of the second well 14 relative to the first well 12 plotted in FIG. 19. An ordinate 212 represents the axial component of magnetic flux density $B_\tau$ in units of nanoTesla (nT) and an abscissa 214 represents the distance in meters (m) along the scan length of the magnetometer trajectory 198 in the first well 12. In the plot 210, line 216 indicates a magnetometer trajectory from coordinates of (x, y, z)=(5, −20, 40) to (x, y, z)=(5, 20, 40). Line 218 represents the magnetometer trajectory 198 from coordinates of (x, y, z)=(10, −20, 40), to (x, y, z) (5, 20, 30). From the plot 210, line 216 reaches a maximum value at numeral 220 and line 218 reaches a maximum value at numeral 222 when the scan length is 20 m. The maxima at numerals 220 and 222 correctly indicate that the point of closest approach between the two wells occurs when the scan length is 20 m. Hence, measuring the axial component of magnetic flux density $B_\tau$ can be used to determine the point of closest approach between the two wells.

Figure 21:
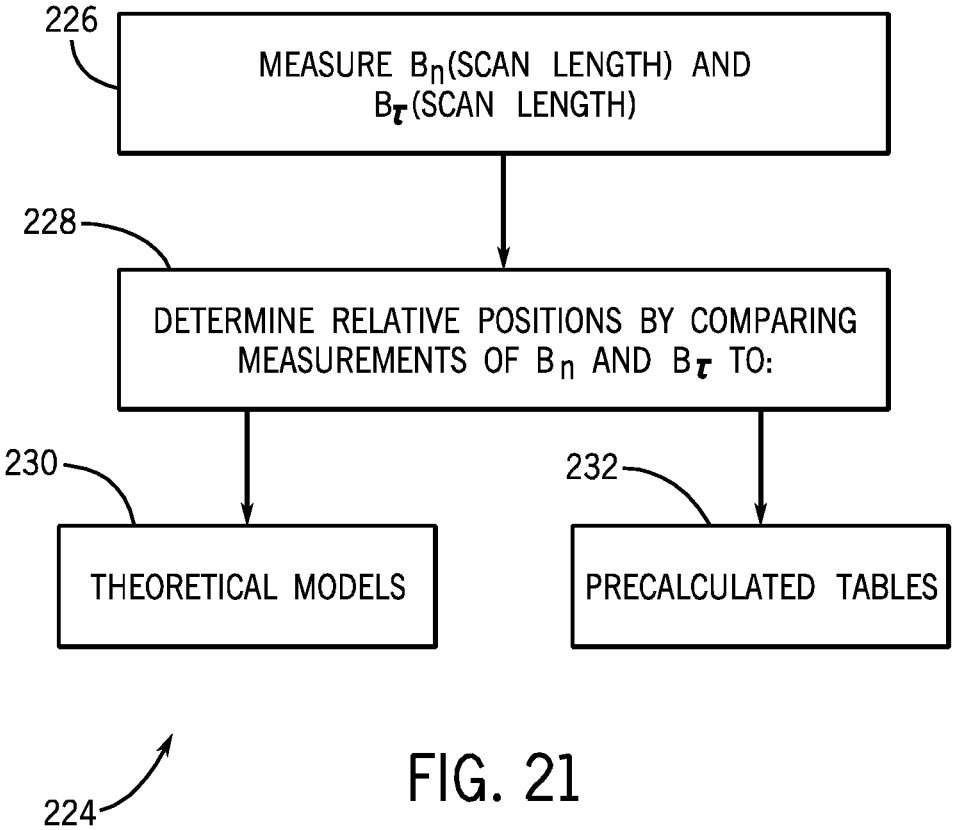
FIG. 21 is a flowchart describing a method of obtaining the relative positions of two non-parallel wells in accordance with an embodiment of the invention.

FIG. 21 represents a flow chart 224 for determining the relative positions between the first well 12 and the second well 14 for the general case of the well drilling operation 196 of FIG. 18. In step 226, the normal component of magnetic flux density $B_n$ and the axial component of magnetic flux density $B_\tau$ are measured along the magnetometer trajectory 198 in the first well 12. In step 228, relative positions of the first well 12 to the second well 14 may be determined.

As indicated in step 230, the determination may take place by comparing measurements of the normal component of magnetic flux density $B_n$ and the axial component of magnetic flux density $B_\tau$ to theoretical models. Such theoretical models may be based on inverting equation (4), disclosed above. Alternatively, as indicated in alternative step 232, the measurements of the normal component of magnetic flux density $B_n$ and the axial component of magnetic flux density $B_\tau$ may be compared to tables created using equation (4) and various angles and distances which may be calculated between the two wells or tables created through routine experimentation. It should be further noted that in the general case illustrated by the well drilling operation 196 of FIG. 18, in which the first well 12 and the second well 14 are not perpendicular, that the alternative mathematical algorithms described in Published Application US 2007/016426 A1, Provisional Application No. 60/822,598, application Ser. No. 11/833,032, and application Ser. No. 11/781,704 may additionally be applied, as discussed above.

While only certain features of the invention have been illustrated and described herein, many modifications and changes will occur to those skilled in the art. Particularly, though the invention has been described with examples involving THAI wells and X-SAGD wells, the techniques may be applied to any relative orientation between two wells. Moreover, although the invention has been described involving a wireline magnetometer 38, the magnetometer could also be deployed in another NWD tool or in a coiled tubing tool, or in a slick line. It is, therefore, to be understood that the appended claims are intended to cover all such modifications and changes as fall within the true spirit of the invention.

What is claimed is:

1. A method comprising:

drilling a new well in a field having an existing well using a bottom hole assembly (BHA) having a drill collar divided by an insulated gap wherein the new well and the existing well are non-intersecting;

generating a current along the drill collar of the BHA while drilling the new well to form an electric dipole over the insulated gap, the dipole having a first pole and a second pole;

calculating a magnetic field strength for the electric dipole for a range of locations, wherein one of the first pole and the second pole has a truncated length with respect to the other;

at the existing well, measuring a magnetic field caused by the electric dipole on the drill collar of the BHA;

comparing the calculated magnetic field strength to the measured magnetic field; and determining a position of the new well relative to the existing well based on the comparing of the calculated magnetic field strength to the measured magnetic field.

2. The method of claim 1, comprising injecting steam at a location in the field selected to be at least a minimum distance away from a point of closest approach between the new well and the existing well.

3. The method of claim 2, comprising using measurements of the magnetic field to determine a distance between the new well and the existing well at the point of closest approach.

4. The method of claim 1, wherein drilling the new well comprises drilling the new well such that a segment of the new well is located within 50 meters of a segment of the existing well.

5. The method of claim 4, wherein drilling the new well comprises drilling the new well such that the segment of the new well located within 50 meters of the segment of the existing well is not parallel to segment of the existing well.

6. The method of claim 1, wherein the BHA includes a drill bit.

7. A method of drilling a well comprising:

drilling a horizontal well in a field having a vertical well using a bottom hole assembly (BHA) having a drill collar divided by an insulated gap wherein the horizontal well and the vertical well are non-intersecting;

generating a current along the drill collar of the BHA while drilling the horizontal well to form an electric dipole over the insulated gap, the dipole having a first pole and a second pole;

calculating a magnetic field strength for the electric dipole for a range of locations wherein one of the first pole and the second pole has a truncated length with respect to the other;

at the vertical well, measuring a magnetic field caused by the electric dipole on the BHA;

comparing the calculated magnetic field strength to the measured magnetic field; and locating a point of closest approach between the vertical well and the horizontal well based on the comparing of the calculated magnetic field strength to the measured magnetic field.

8. The method of claim 7, comprising adjusting a drilling trajectory of the BHA while drilling the horizontal well based on measurements of the magnetic field when a drill bit of the BHA approaches within 30 m of the vertical well.

9. The method of claim 7, comprising injecting steam at a location in the field selected to be at least a minimum distance away from the point of closest approach between the horizontal well and the vertical well.

10. The method of claim 9, wherein the point of closest approach is located by observing when a vector component of the magnetic field changes sign.

11. The method of claim 9, wherein the point of closest approach is located by observing when a vector component of the magnetic field reaches a peak.

12. The method of claim 7, comprising estimating a distance between the vertical well and the horizontal well at the point of closest approach.

13. The method of claim 7, comprising estimating a distance between the vertical well and the horizontal well based on a change in magnetic flux as the BHA moves toward or away from the vertical well.

14. The method of claim 7, wherein the horizontal well and the vertical well are Toe to Heel Air Injection (THAI) wells.

15. The method of claim 7, wherein the BHA includes a drill bit.

16. A method of drilling a well comprising:

drilling a new well in a field having an existing well wherein the new well and the existing well are non-intersecting;

generating a magnetic field from an electric dipole in the new well along a drill collar of a bottom hole assembly (BHA), the dipole having a first pole and a second pole;

calculating a magnetic field strength for the electric dipole for a range of locations, wherein one of the first pole and the second pole has a truncated length with respect to the other, measuring the magnetic field using a magnetometer disposed in the existing well;

comparing the calculated magnetic field strength to the measured magnetic field; and determining a point of closest approach between the new well and the existing well based on the comparing of the calculated magnetic field strength to the measured magnetic field.

17. The method of claim 16, comprising adjusting a drilling trajectory of the new well based on measurements of the magnetic field.

18. The method of claim 16, comprising determining a relative position of the new well to the existing well based on measurements of the magnetic field.

19. The method of claim 16, wherein the BHA includes a drill bit.

* * * * *